US005324202A

United States Patent [19]

Meyers et al.

[11] Patent Number: 5,324,202

[45] Date of Patent: Jun. 28, 1994

[54] LUMINESCENT DISPLAY AND COPYING APPARATUS AND METHOD FOR USING SAME

[75] Inventors: Norman O. Meyers, Fort Wayne, Ind.; Masayuki Kondo, Takayama, Japan

[73] Assignee: The Ohio Art Company, Bryan, Ohio

[21] Appl. No.: 936,943

[22] Filed: Aug. 27, 1992

[30] Foreign Application Priority Data

Jan. 27, 1992 [JP] Japan ..... 4-007779[U]

[51] Int. Cl.[5] ..... B43L 1/12

[52] U.S. Cl. ..... 434/410; 428/488.1; 434/415

[58] Field of Search ..... 434/408, 410, 415; 428/488.1, 488.4

[56] References Cited

U.S. PATENT DOCUMENTS

| | | | |
|---|---|---|---|
| 1,556,499 | 10/1925 | Deutsch | 434/410 |
| 2,596,890 | 5/1952 | Dechert | 434/410 |
| 3,761,343 | 9/1973 | Kinberg et al. | 428/46 |
| 4,011,665 | 3/1977 | Port | 434/410 |
| 4,761,139 | 8/1988 | Mashiach | 434/410 |
| 4,927,748 | 5/1990 | Kinberg | 434/410 |
| 5,083,925 | 1/1992 | Maruyama | 434/410 |

*Primary Examiner*—Gene Mancene
*Assistant Examiner*—Jeffrey A. Smith
*Attorney, Agent, or Firm*—Knobbe, Martens, Olson & Bear

[57] ABSTRACT

An apparatus and method for providing a luminescent display by applying pressure to a transparent planar sheet containing a luminescent dye or pigment where such pressure is sufficient to cause one smooth surface of the transparent sheet to contact a facing smooth surface of an opaque planar sheet, the smooth surfaces of the transparent and opaque sheets tending to adhere together at the area of contact, thereby creating a luminescent image at the area of contact which can be selectively erased by separating the smooth surfaces of the transparent and opaque sheets at the area of contact, and for allowing copying of the image by positioning a sheet of carbon paper between the opaque sheet and a sheet of plain paper so that the application of pressure to the transparent sheet causes pressure to be applied through the carbon paper to the sheet of plain paper, thereby copying the image displayed on the transparent sheet onto the sheet of plain paper, the carbon paper being selectively movable to allow segments of carbon paper which can produce images of different colors to be positioned between the opaque sheet and the sheet of plain paper during the drawing of an image to facilitate the production of a multi-colored copy of the displayed image, the apparatus allowing the use of different sizes and multiple sheets of plain paper and providing means for ejecting such paper from the apparatus.

54 Claims, 13 Drawing Sheets 10
11
12
14
22
24
26
30
31
33
40
49
57
60
62
67
68
73
80
96
112
120
121
122
123
124

FIG. 6
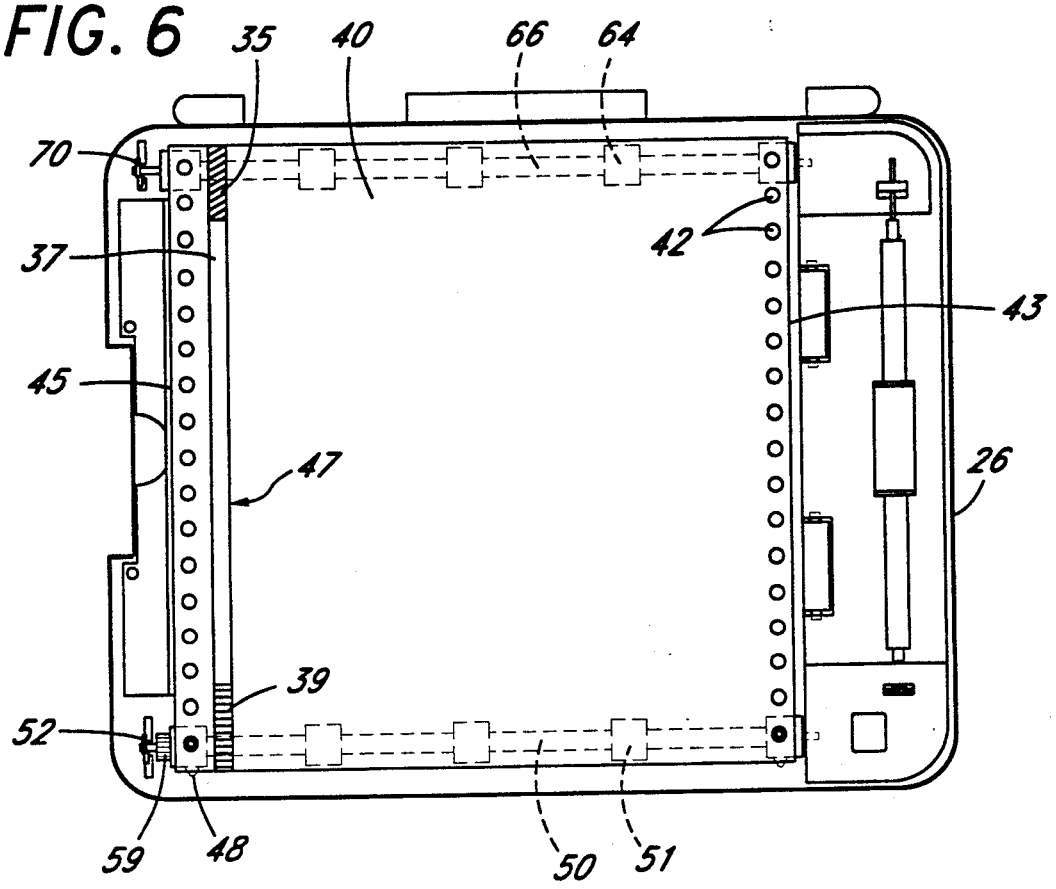
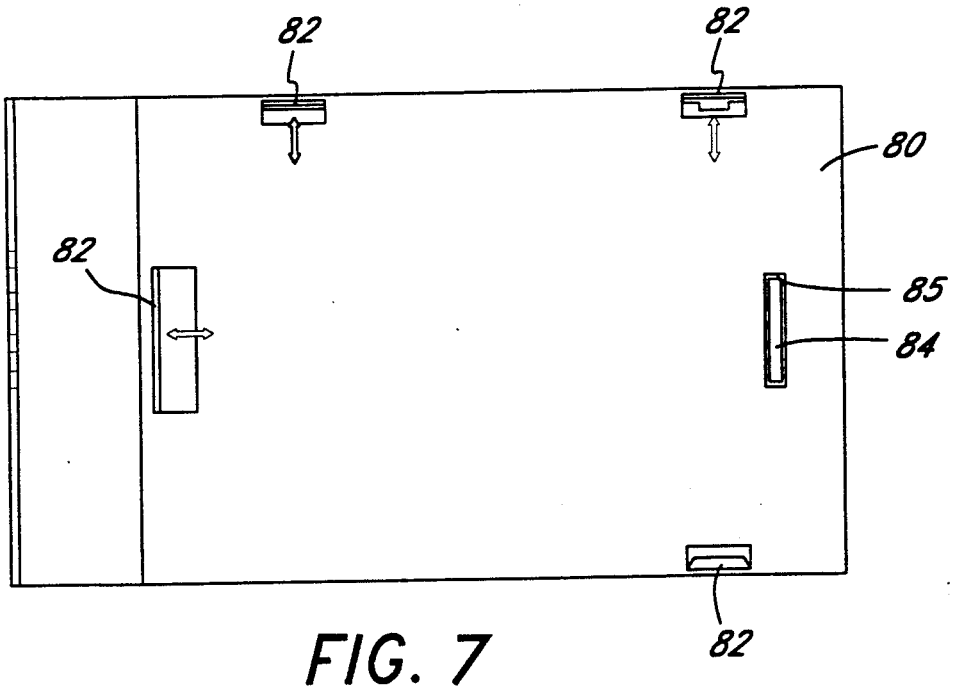
FIG. 7

LUMINESCENT DISPLAY AND COPYING APPARATUS AND METHOD FOR USING SAME

BACKGROUND OF THE INVENTION

When a luminescent pigment is applied to an opaque surface and light is shined on that surface, the luminescent pigment appears to glow. This optical property of luminescent pigments has been used in a variety of applications, including increasing the visibility of signs at night. Luminescent pigments have also been put to use in display devices, particularly toys made for children. In this application, a flexible, transparent sheet containing a luminescent pigment is overlaid on an opaque surface. When pressure is applied to the transparent sheet, it touches and adheres to the opaque surface, causing light to be reflected through the transparent sheet at the point of contact between the sheet and the opaque surface. Due to the presence of the luminescent pigment in the transparent sheet, light reflected by the opaque surface makes the sheet appear to glow where it contacts the opaque surface. The glowing image may then be erased by lifting the transparent sheet so that it no longer contacts the opaque surface. A display device of this type incorporating the use of luminescent pigments is disclosed in U.S. Pat. No. 3,761,343 to Kinberg, et al.

A similar device is disclosed in U.S. Pat. No. 4,011,665 to Port. In this device a rigid bar is used to separate a transparent, pigmented sheet from an opaque surface in order to erase a luminescent image on the transparent sheet.

More recently, a luminescent display and copying device was disclosed in U.S. Pat. No. 5,083,925 to Maruyama. This device includes a sheet of carbon paper below a semi-rigid opaque sheet. The opaque sheet is itself positioned just below a conventional transparent, pigmented sheet. When an image is traced on the transparent sheet, the pressure applied to that transparent sheet is transferred through the opaque sheet to the carbon paper. The pressure on the carbon paper then causes a duplicate of the luminescent image created on the transparent sheet to be transferred to a blank sheet of plain paper located below the carbon paper. Thus, a copy of the luminescent image traced on the transparent sheet is created on the blank sheet of paper.

Several problems have been identified with the Maruyama device and other prior art devices. The single sheet of carbon paper contemplated by Maruyama for making a copy of a displayed image, for example, only allows the creation of single-colored copies. To create a multi-colored copy with the Maruyama device, the user would have to lift the closure frame to which the carbon paper is attached and replace the sheet of carbon paper with one of another color. Replacing the carbon paper in this way is difficult and messy, especially for children. Moreover, lifting the closure frame to replace the carbon paper can cause the luminescent image on the screen to disappear. Making multi-colored copies with the Maruyama device is therefore impracticable.

A further problem with the Maruyama device is that it does not accommodate or even contemplate using different sizes of plain paper to make copies on. In addition, it is incapable of containing more than one sheet of plain paper at a time. This shortcoming in particular makes the Maruyama device more difficult for children to use, since they must open and close the closure frame of the device every time they wish to make a new drawing and a copy of that drawing.

SUMMARY OF THE INVENTION

The present invention comprises a luminescent display and copying apparatus capable of producing multi-colored copies of a displayed luminescent image. The present invention overcomes the color limitations of the prior art by providing selectively movable carbon paper on a continuous belt having segments of different colors capable of producing copies of a plurality of colors. In a preferred embodiment, the present invention comprises a pliable, planar transparent sheet having dispersed therein a luminescent dye or pigment; a pliable, planar opaque sheet; carbon paper having a plurality of segments each of which is capable of producing images of a different color; means for selectively moving the carbon paper; and means for supporting a sheet of plain paper underneath the carbon paper segments.

Multi-colored copies can be produced with this embodiment of the present invention without lifting a closure frame or touching the carbon paper, as was necessary with prior art devices. Instead, the color imparted by the carbon paper positioned over a sheet of paper in the apparatus is changed by manipulating controls on the exterior of the apparatus. Such ease of color selection is wholly lacking in prior art display and copier devices, making the present apparatus more suitable as a child's toy.

The prior art also failed to provide means for accommodating plain paper of different sizes. Therefore, in another preferred embodiment, a luminescent display and copying apparatus is provided which includes a means for supporting a sheet of plain paper selected from a plurality of sizes, in addition to providing a pliable, planar transparent sheet, a pliable, planar opaque sheet, and carbon paper. In a particularly preferred embodiment, both $8\frac{1}{2}'' \times 11''$ paper, which is standard in the United States, and A4 paper, which is standard in Europe, can be used.

In addition to their other failings, prior art copying devices also lacked means for accommodating more than one sheet of plain paper at a time. A further embodiment of the present invention therefore comprises a luminescent display and copying apparatus having a pliable, planar transparent sheet, a pliable, planar opaque sheet, carbon paper, means for supporting multiple sheets of plain paper, and means for dispensing sheets of paper, one sheet at a time. When a user desires to make an image and a copy of that image, therefore, he or she does not need to open the apparatus every time to insert a clean sheet of plain paper. Rather, the apparatus of the present invention needs to be refilled with plain paper only after a number of copies have been made and the supply of paper in the apparatus runs out. This improvement makes the present display and copying apparatus particularly appropriate for children who might have trouble placing clean sheets of plain paper into the apparatus, since the child's parents can refill the apparatus for the child periodically and let the child make multiple drawings without interruption. Furthermore, although multiple sheets of paper can be contained in this embodiment of the present invention, only one sheet is dispensed at a time.

The present invention also includes methods of using the foregoing embodiments of the present invention. For example, a method is provided for producing multi-colored copies of a luminescent display. Such multi-colored copies are produced by first applying pressure to the transparent sheet of one of the foregoing embodiments of the present invention while one segment of carbon paper capable of imparting one color to a sheet of plain paper is positioned over that sheet of plain paper. This will produce an image on the sheet of plain paper of a single color. The carbon paper is then moved so that another segment of carbon paper capable of producing images of a second color is positioned over the plain paper. When pressure is again applied to the display portion of the apparatus, the image produced on the plain paper by this application of pressure will be of the second color.

In accordance with another method of using the present invention, the opaque or transparent sheets can be easily replaced. These sheets tend to wear out more quickly than other parts of the apparatus. They are also more easily torn or punctured. Therefore, the transparent and opaque sheets can be removed from the apparatus and replaced by new ones. In this method, a means for securing the transparent or opaque sheets is removed from the damaged sheet, and the damaged sheet is then itself removed. A replacement transparent or opaque sheet next replaces the damaged sheet, and the replacement sheet is secured to the frame or housing, respectively.

The present invention further encompasses methods of producing a belt of carbon paper for use in the embodiments of the apparatus of the present invention. To make a the belt of carbon paper, standard carbon paper is adhered to a sheet of more rugged carrier paper having two parallel sides and two ends. Alternatively, ink can be directly applied to such a sheet of carrier paper. The ends of the carrier paper in either case are then fastened so that the inked side or the side to which the carbon paper is adhered faces the interior of the belt. A continuous belt of carbon paper is thus produced.

BRIEF DESCRIPTION OF THE DRAWINGS

These and other features of the invention will now be described with reference to the drawings of a preferred embodiment which is intended to illustrate and not to limit the invention, and in which:

FIG. 6 is a top view of the contents of the housing of the apparatus with the upper portion of the housing removed.

FIG. 7 is a top view of the paper tray of the apparatus.

DETAILED DESCRIPTION OF THE PREFERRED EMBODIMENT

Figure 1:
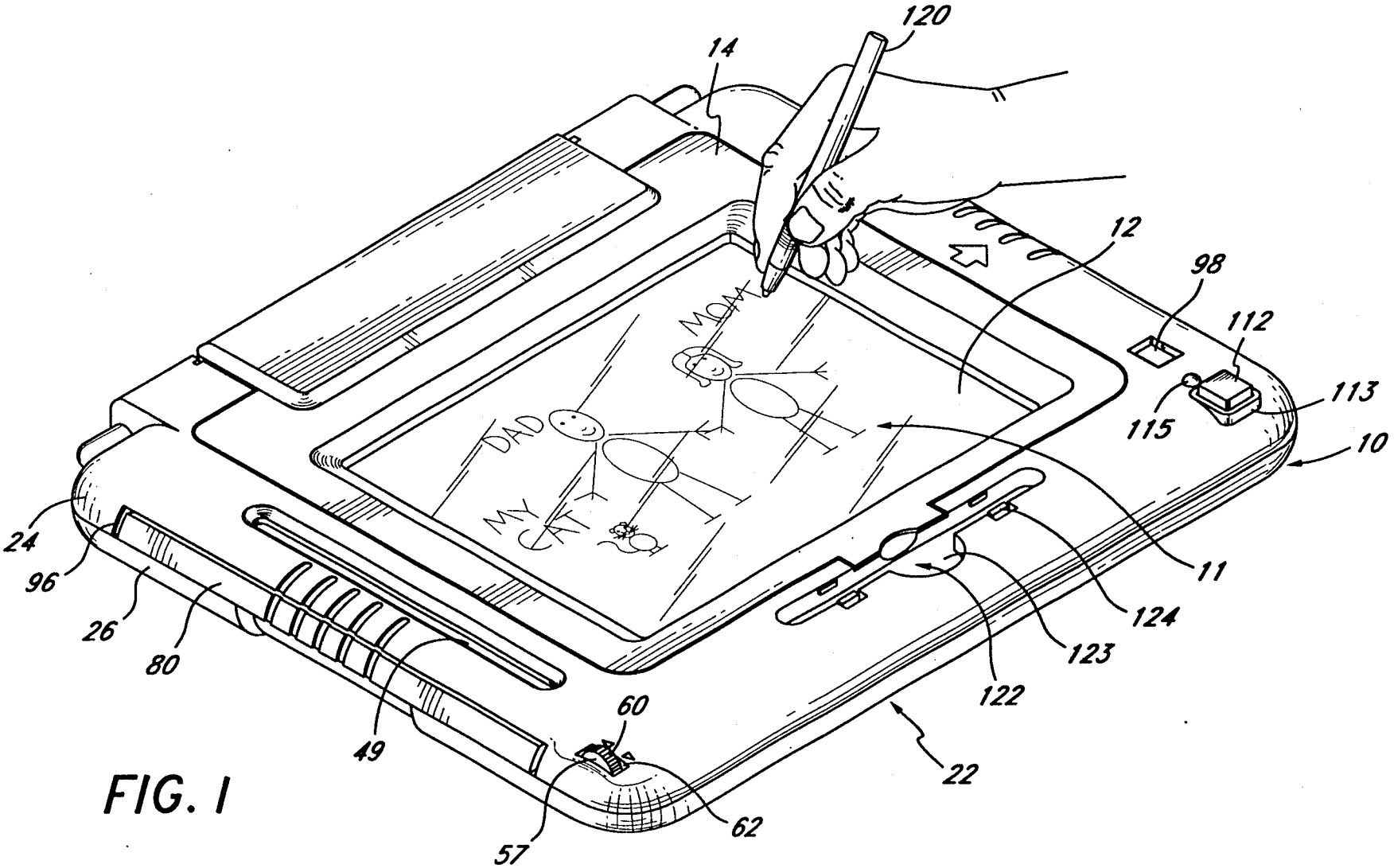
FIG. 1 is a perspective view illustrating the creation of a display on the luminescent display and copying apparatus of the present invention using a stylus.
Figure 2:
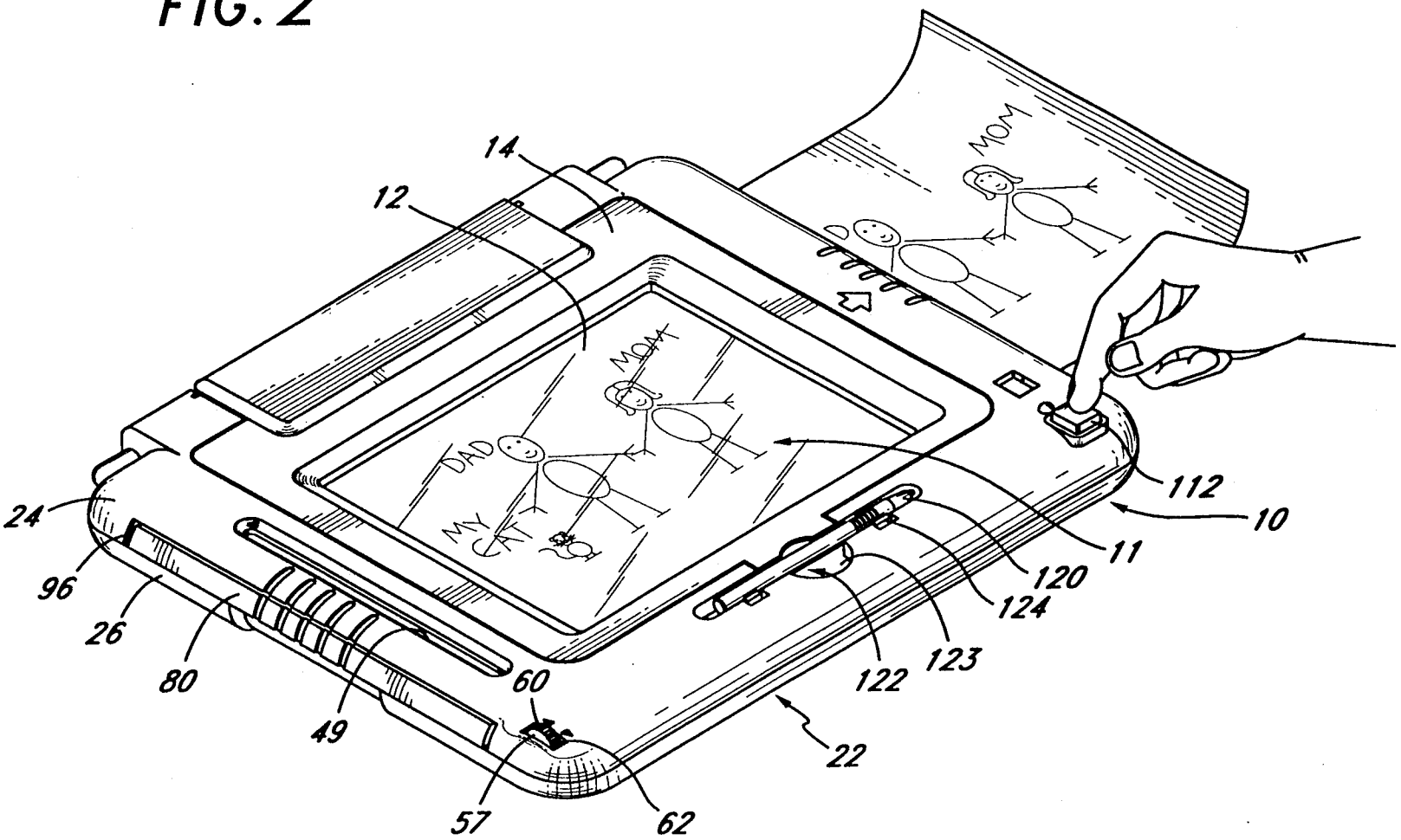
FIG. 2 is a perspective view showing the luminescent display and copying apparatus dispensing a copy of the display shown in FIG. 1.
Figure 3:
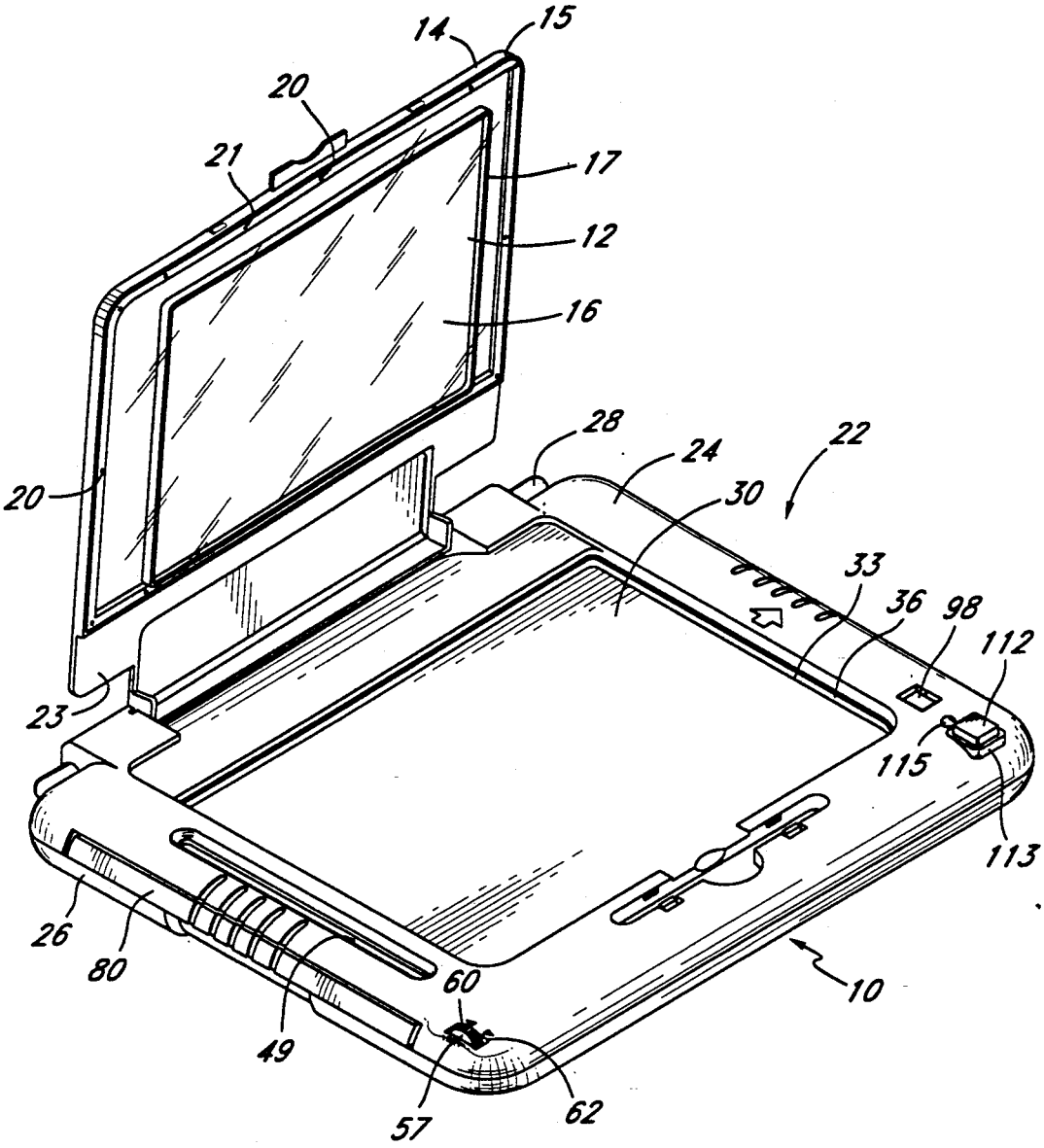
FIG. 3 is a perspective view showing the frame and transparent sheet of the apparatus in the open position.

FIGS. 1–3 illustrate the components of the apparatus 10 of the present invention used to create a luminescent display. The surface on which a display is produced, first of all, is a planar, transparent sheet of pliable plastic material 12, having dispersed therein a luminescent pigment or dye. The transparent sheet 12 has a smooth lower surface 13 and an upper surface 14 which resists scratches and tears. The transparent sheet 12 is preferably made from a vinyl material, and the pigment or dye used to impart a luminescent coloration to the vinyl is therefore preferably one which mixes well with vinyl. Of course, other materials and pigments may be used, such as those disclosed in U.S. Pat. Nos. 2,938,873, 3,303,168, 3,915,884 and 4,820,760, which are expressly incorporated herein by reference for such disclosures.

Figures 1A, 1B:
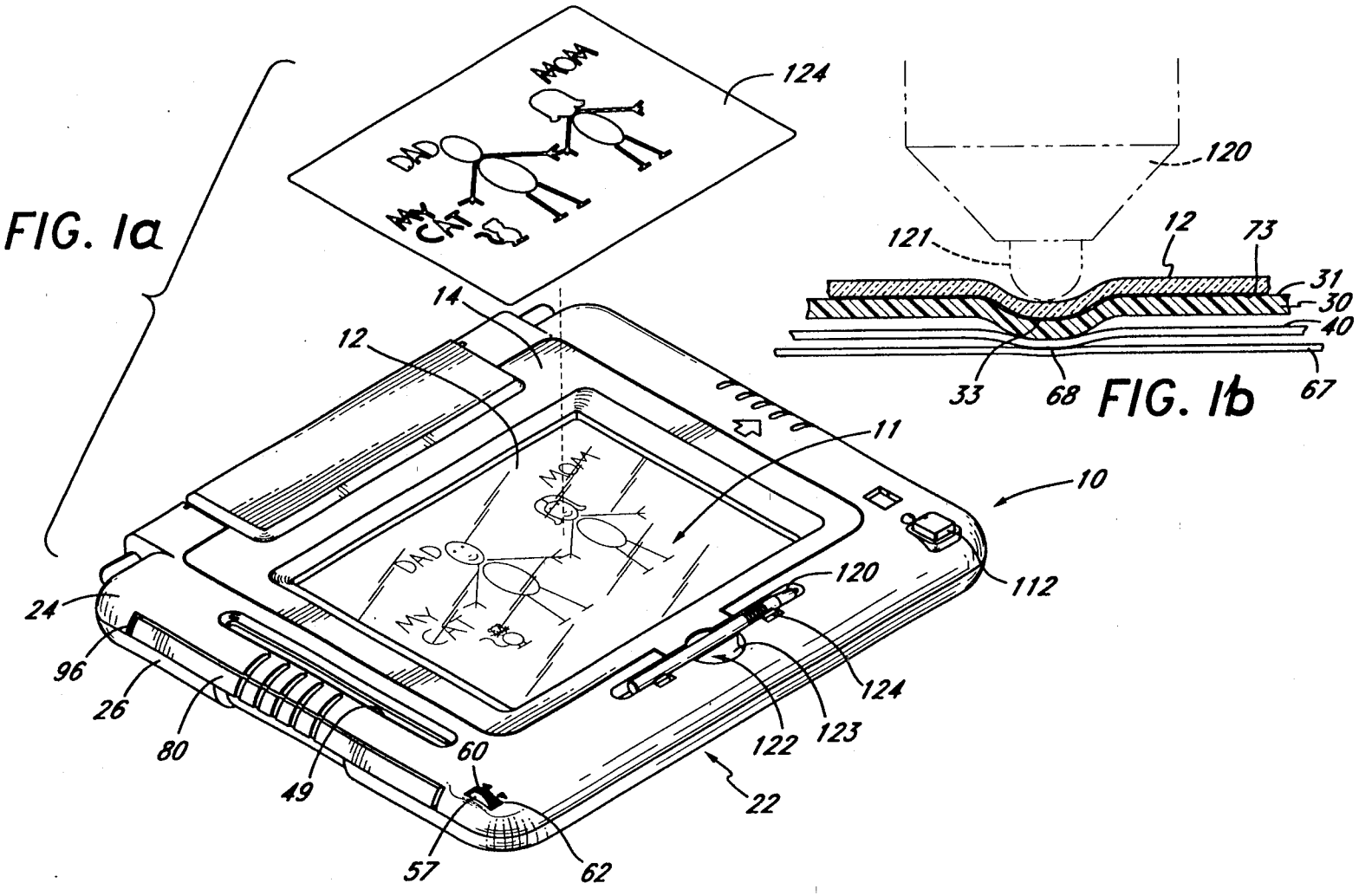
FIG. 1*a* is a perspective view illustrating the creation of a display on the apparatus with the aid of a stencil.
FIG. 1*b* is a cross-sectional view of the transparent sheet, the opaque sheet, the carbon paper, and the plain paper of the present invention when pressure is applied to the transparent sheet with a stylus.

The transparent sheet 12 is placed over a planar, pliable opaque sheet 30 before a display is produced. The opaque sheet 30, which is also preferably made from a vinyl material, has a smooth upper surface 31 which faces the smooth lower surface 13 of the transparent sheet 12. To create a luminescent display, sufficient pressure is applied to the transparent sheet 12 with a stylus 120 so that the smooth lower surface 13 of the transparent sheet 12 contacts and adheres to the smooth upper surface 31 of the opaque sheet 30 at a point 33 (FIG. 1*b*). At the point 33, where the transparent sheet 12 contacts the opaque sheet 30, the transparent sheet 12 appears to glow. This luminescent phenomenon is described in detail in U.S. Pat. No. 4,011,665, which is expressly incorporated herein by reference for such disclosure.

The stylus 120 used to apply pressure to the transparent sheet 12 and to create an image 11 preferably has a relatively soft, rounded tip 121 so that the stylus 120 can be drawn across the transparent sheet 12 without damaging it. Since the use of a drawing tool other than the stylus 120 might damage the transparent sheet 12 and the opaque sheet 30, the stylus 120 is preferably stored with the apparatus when the apparatus 10 is not in use. The stylus 120 is thus readily available when the apparatus 10 is to be used. The stylus 120 may be stored by placing it in a retainer attached to the housing 22 such as a retainer well 122. The retainer well 122 is preferably integrally molded into housing 22. The retainer well 122 also preferably includes semi-circular depressions 123 to aid in manually grasping the stylus 120 when a user desires to remove the stylus 120 from the well 122. Tabs 124 for holding the stylus 120 in the well 122 may be included as well. The stylus 120 may be conveniently attached to the housing 22 by means of a tether (not shown) secured to the end of the stylus 120 opposite the tip 121. Such a tether may be conveniently formed of string, coiled plastic or other suitable material.

In order to facilitate the adherence of the transparent sheet 12 to the opaque sheet 30, the upper surface 31 of the opaque sheet 30 should be in close proximity to the lower surface 13 of the transparent sheet 12, that is, within approximately one-sixteenth inch. The stable adherence of the transparent sheet 12 to the opaque sheet 30 for a period of time is necessary to the creation of an image. Preferably, the display created by the application of pressure to the transparent sheet 12 should not disappear before a complete image 11 is created. Of particular preference is an arrangement where the transparent sheet 12 does not separate from the opaque sheet 30 unless physically lifted or otherwise separated.

The adherence of the transparent sheet 12 to the opaque sheet 30 must, however, also be reversible so that a displayed image can be erased. To erase an image, the transparent sheet 12 may be lifted from the opaque sheet 30 so that contact between the lower surface 13 of the transparent sheet 12 and the upper surface 31 of the opaque sheet 30 is broken. In the preferred embodiment shown in FIGS. 1-3, the image 11 formed on the transparent sheet 12 is erased when a frame 14 secured to the transparent sheet 12 is lifted. As shown in FIG. 3, the frame 14 rotates about a hinge 28, lifting the transparent sheet 12 off the opaque sheet 30 and erasing the image as the frame 14 rotates. Thus, the rotated frame 14 and transparent sheet 12 no longer contain the image displayed on the apparatus 10 in FIGS. 1-2. Other forms of separating the sheets 12, 30 are also contemplated by the present invention, such as separating them with a rigid bar (not shown) or with another device passed between the sheets 12, 30.

As shown in FIG. 2, the display surface of the transparent sheet 12 is surrounded by the frame 14. The frame 14 can be made from any suitably rigid, lightweight material, but is preferably made from ABS plastic. The frame 14 defines an aperture 16 which is bounded by lip 17 on the frame 14. The lip 17 extends generally perpendicular to the surface of the frame 14. The transparent sheet 12 is stretched tautly across the aperture 16 over the lip 17 and is secured to the frame 14.

As best shown in FIG. 3, the outer edges of the transparent sheet 12 are preferably removably secured to the underside 23 of the frame 14. The means for removably securing the transparent sheet 12 may take the form of an upper retaining frame 21 and a plurality of fasteners, such as screws 20. The retaining frame 21 is generally planar and generally rectangular and has a central aperture large enough to fit over the lip 17 on the frame 14. The screws 20 preferably extend through the retaining frame 21 into tapped holes (not shown) in the frame 14. Self-tapping screws 20 may be used instead of providing tapped holes in the frame 14. The upper retaining frame 21 and the screws 20 secure the transparent sheet 12 tautly to the underside 22 of the frame 14, by stretching the transparent sheet 12 over the lip 23 surrounding the aperture in the frame 14 so that wrinkles do not form on the transparent sheet 12 when an image is drawn on it. Of course, alternative constructions of the retaining frame 21 and screws 20 will be apparent to those of ordinary skill in the art. For example, other means of fastening the transparent sheet 12 to the frame 14 may be substituted for the screws 20. Likewise, the retaining frame 21 need not be a single rectangular piece, but could take the place of four straight pieces, a pair of L-shaped pieces, or other suitable configurations.

Should the transparent sheet 12 become damaged due to prolonged use or an untimely accident, it may be replaced by removing the screws 20 and the upper retaining frame 21 and removing the damaged transparent sheet. A replacement sheet may then be placed against the underside 23 of the frame 14 across the aperture 16 and over the lip 17 of the frame 14. The replacement transparent sheet may then be secured to the frame 14 by replacing the upper retaining frame 21 over the replacement sheet and screwing the screws 20 into the upper support frame 21, through the replacement sheet, and into the frame 14. Screwing the retaining frame 21 over the replacement transparent sheet against the underside 23 of the frame 14 acts to stretch the replacement sheet over the lip 23 so that the replacement sheet is stretched taut.

As shown in FIG. 3, the frame 14 is rotatably secured to an upper portion 24 of a housing 22 by means of hinges 28. The housing 22 may be made from any suitably strong and rigid material, but is preferably made from ABS plastic. When the frame 14 rests on the upper portion 24 of the housing 22, the lower surface 13 of the transparent sheet 12 faces the upper surface 31 of the opaque sheet 30 and the two sheets 12, 30 are in close and parallel relationship. Thus, as shown in FIG. 1, the transparent sheet 12 is in position to create a display when the frame 14 rests on the upper portion 24 of the housing 22.

The frame 14 preferably rotates through an arc of at least 90° on the hinges 28. When rotated 90° or more, the frame 14 and plastic sheet 12 can rest stably in an open position, as shown in FIG. 3. The frame 14 and transparent sheet 12 are more preferably rotatable through an arc of greater than 180° so that the free end 15 of frame 14 may be rotated, back to rest on the surface (not shown) supporting the apparatus 10. In this position, the hinges 28 of the frame 14 are under less stress when the frame 14 is open.

Figure 4:
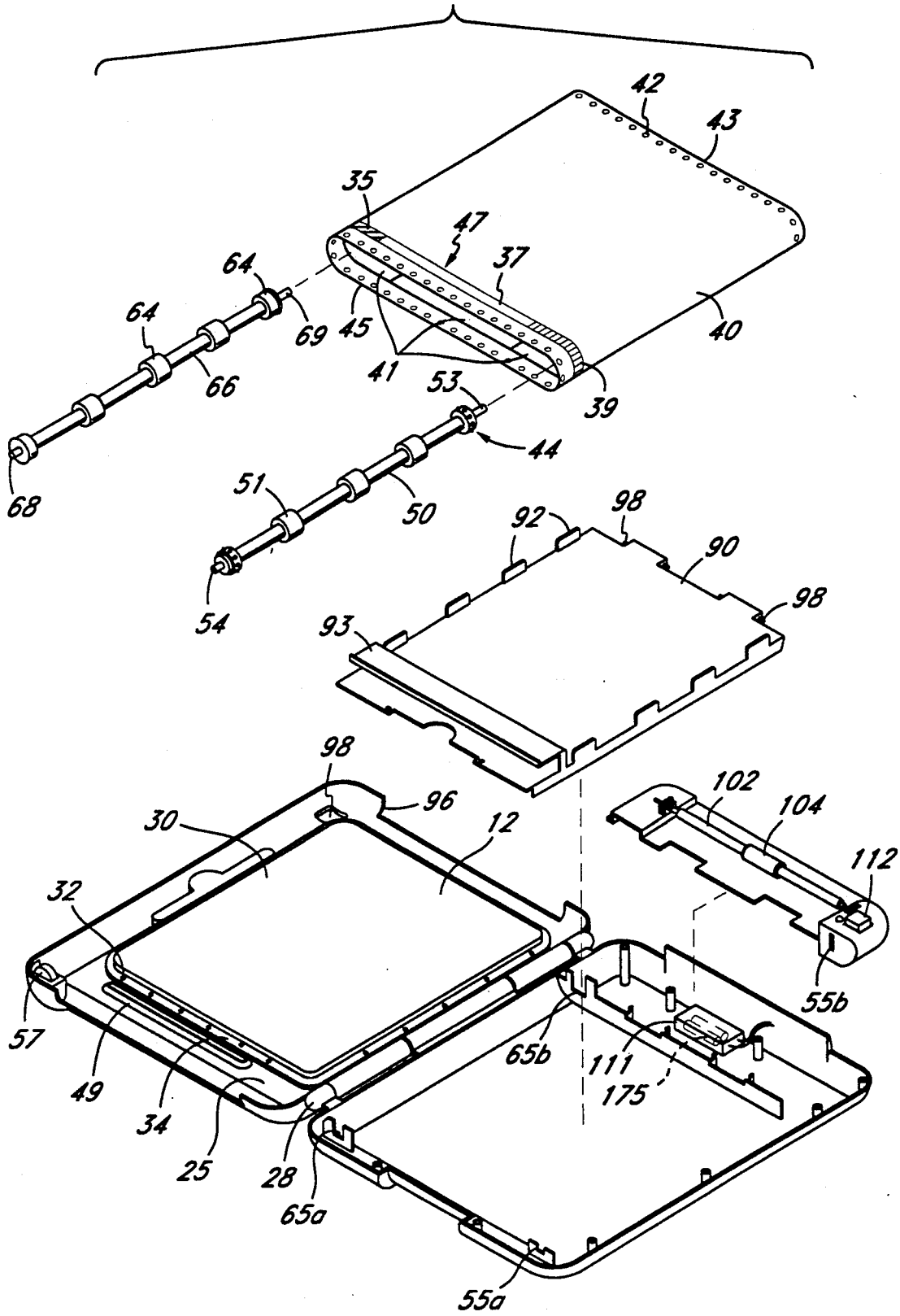
FIG. 4 is an exploded view of the parts of the apparatus inside the housing.

As shown in FIG. 3, the upper surface of the opaque sheet 30 is bounded by a generally planar aperture 33 defined by a lip 36 on the upper portion 24 of the housing 22. The lip 36 extends downward into the housing 22 roughly perpendicular to the plane of the aperture 33. As best seen in FIG. 4, the opaque sheet 30 is stretched taut across the aperture 33 over the lip 36. A lower retaining frame 34 secures the opaque sheet 30 to the underside 25 of the upper portion 24 of the housing 22 by means of a plurality of fasteners, such as screws 32. The screws 32 preferably extend through the lower retaining frame 34 into tapped holes (not shown) in the underside 25 of the upper portion 24 of the housing 22. Self tapping screws, or other fastening means, may be used instead of providing tapped holes in the underside 25 of the upper portion 24 of the housing 22. The lower retaining frame 34 and screws 32 secure the opaque sheet 30 tautly over the lip (not shown) surrounding the aperture through the housing 22 to the housing 22 so that wrinkles do not form on the opaque sheet 30 when an image is drawn on the transparent sheet 12. Alternative constructions of the lower retaining frame 34 and screws 32 for securing the opaque sheet 30 to the underside 25 of the upper portion 24 of the housing 22 will be apparent to those of ordinary skill in the art.

The opaque sheet 30, like the transparent sheet 12, may become damaged through prolonged use or untimely accident. In the preferred embodiment, therefore, the opaque sheet 30 is removably secured to the housing 22. Should the opaque sheet 30 become damaged, the opaque sheet 30 may be removed from the upper portion 24 of the housing 22 by unscrewing the screws 32 and removing the lower retaining frame 34. After removing the damaged opaque sheet, a replacement opaque sheet 30 may be placed over the lip 36 on underside 25 of the upper portion 24 of the housing 22. The retaining frame 34 may then be replaced against the replacement opaque sheet 30, which may then be secured to the housing 22 by screwing the screws 32 into the lower retaining frame 34, through the replacement opaque sheet 30, and into tapped holes (not shown) in the upper portion 24 of the housing 22. Screwing the retaining frame 34 to the housing 22 stretches the opaque sheet 30 over the lip (not shown) so that the opaque sheet 30 is stretched taut.

Figure 5:
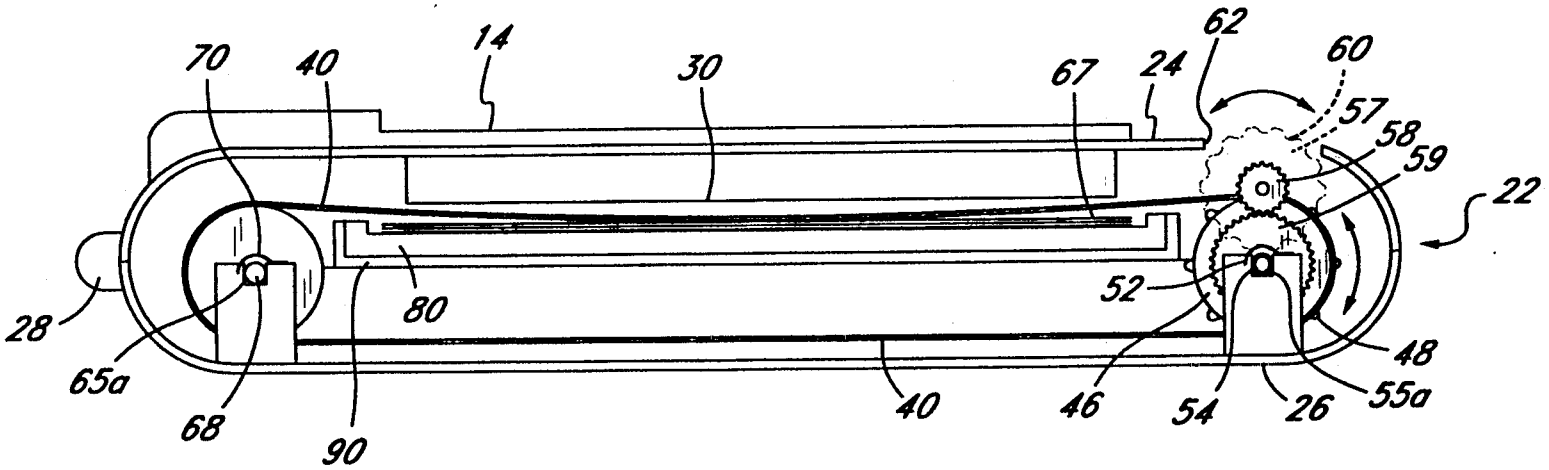
FIG. 5 is a schematic, cross-sectional view depicting the movement of the belt of carbon paper in the apparatus.

As shown in FIGS. 4 and 5, located directly beneath the opaque sheet 30 is a continuous belt of carbon paper 40. The belt of carbon paper 40 has a plurality of segments 41 on the interior of the belt 40 which contain different colors of inks, thereby forming a multi-colored belt of carbon paper 40. Each of the segments 41 is of a different color and is, therefore, capable of producing images of a different color on a sheet of plain paper 67 positioned underneath a segment of carbon paper 41 and on the interior of the belt of carbon paper 40. The belt of carbon paper 40 has two parallel edges 43, 45 and is preferably made from a durable material constructed to last for the life of the apparatus 10.

In one embodiment, the belt of carbon paper 40 is made from durable paper, preferably such as "TYVAC" which is available from duPont, having two parallel edges 43, 45 and forming a generally rectangular planar carrier sheet. Segments of carbon paper capable of imparting images of different colors to a sheet of plain paper 67 may be adhered to one side of the carrier sheet in this embodiment. Alternatively, inks or pigments of different colors can be deposited directly onto one side of the durable paper, such that different segments 41 of the durable paper carry inks of a different color. In both embodiments, the durable paper is then formed into a belt by joining the ends of the paper so that the parallel edges 43, 45 remain parallel and are of equal length. The pigmented side of the durable paper or the side to which the carbon paper is adhered must also be on the interior of the belt 40. Perforations 42 may also be placed at regular intervals along the parallel edges 43, 45 of the paper so that the belt of carbon paper 40 can be readily and positively moved. A particularly preferred embodiment of the belt 40 employs segments 41 of blue, black and red carbon paper.

As a further alternative embodiment, the carbon paper 40 could be placed on rolls (not shown) to allow the carbon paper 40 to be scrolled back and forth, thereby allowing selection of the different colors. This embodiment would also allow ready replacement of the carbon paper rolls.

The segments 41 of carbon paper are preferably sized so that each segment 41 can be positioned beneath the opaque sheet 30 and be at least coextensive in area with the display portion of the transparent sheet 12. The color of a segment 41 of the belt of carbon paper 40 may be visually indicated along at least one lateral edge, 43 or 45, of the exterior of the belt of carbon paper 40 by a color strip 47, as shown in FIGS. 4 and 6. The color strip 47 is divided into segments 35, 37, and 39 that correspond to the segments 41 of the interior of the belt of carbon paper 40 which are capable of producing copies of different colors. The color of a segment 35, 37, 39 of the color strip 47 indicates the color imparted by the segment 41 of the belt of carbon paper 40 onto a sheet of paper 67 when an image 11 is drawn on the transparent sheet 12.

The color strip 47 can be seen from the outside of the apparatus 10 through a viewing window 49 in the upper portion 24 of the housing 22, as shown in FIGS. 1-3. Preferably, a transparent cover (not shown) is secured to underside 25 of the upper portion 24 of the housing 22 between the color strip 47 and the viewing window 49 so that small objects cannot fall into the housing 22 of the apparatus 10, and so that slender objects cannot be inadvertently placed through the viewing window 49 to damage the belt of carbon paper 40. The viewing window 49 is preferably just wide enough to expose the color strip 47 and extends over the color strip 47 for approximately the length of a segment of the color strip 47. By viewing the color of the segment of the color strip 47 exposed by the viewing window 49, a user of the apparatus can determine what color copy will be made of an image drawn on a portion of the transparent sheet 12.

A preferred embodiment of the present invention includes a means for making multi-colored copies of a displayed image 11 which requires a minimum of effort and inconvenience to select the color to be imparted onto a sheet of plain paper 67. In a preferred embodiment, such a means for making multi-colored copies comprises a means for selectively moving the belt of carbon paper 40 without displacing the transparent or opaque sheets. By rotating the belt of carbon paper 40, a different segment of carbon paper 41 is positioned directly over a sheet of plain paper 67. Thus, copies of different colors can then be produced of an image drawn on the transparent sheet 12.

In order to move the belt of carbon paper 40 and position a particular segment 41 of the belt of carbon paper 40 underneath the opaque sheet 30 and over a sheet of plain paper 67 so as to produce copies of a desired color, the perforations 42 located on both sides of the carbon paper 40 are engaged by toothed rollers or sprockets 44. As shown in FIG. 4, the toothed rollers 44 comprise wheels 46 having protruding pins 48 which project radially outwardly from the outer edges of each of the wheels 46. When the toothed rollers are rotated, the pins 48 protrude through the perforations 42 as best seen in FIG. 5. The pins 48 push against the paper 40 at the edges of the perforations 42 and thereby move the belt of carbon paper 40 in a desired direction. The toothed rollers 44 could be replaced by a friction drive, for example, opposed grit rollers and pinch rollers.

The toothed rollers 44 on either side of the carbon paper 40 are joined by a shaft 50 located on the interior of the belt of carbon paper 40, as shown in FIGS. 4 and 5. Located along the shaft 50 intermediate the toothed rollers 44 at regular intervals are cylindrical passive rollers 51 which help the carbon paper to keep a smooth, uniform shape as it is moved by the toothed rollers 44. The shaft 50 also has an axial projection 54 which extends outwardly from the center of the wheel 46 along the longitudinal axis of the shaft 50. This projection 54 rests in the notch 55*a* so that the shaft 50 is freely rotatable. The projection 54 is secured in the notch 55*a* by a clip 52, thus securing one end of the shaft 50 in the lower portion 24 of the housing 22. Alternative means of retaining the projection 54 with the notch 55*a* will be apparent to those of ordinary skill, including mounting the projection 54 within a bearing (not shown) pressed into the notch 55*a*. Another axial projection 53 extends outwardly from the other lengthwise end of the shaft 50 along the longitudinal axis of the shaft 50 and is held in place by a slot 55*b*, as shown in FIG. 4, thus securing this end of the shaft 50. As with notch 55*a*, slot 55*b* may be replaced with conventional alternatives for securing the axial projection 53, such as a notch and a clip. Once the shaft 50 is mounted in notch 55*a* and slot 55*b* and the projection 54 is secured by the clip 52, the shaft 50 is freely rotatable.

The wheels 46 of the toothed rollers 44 on either side of the shaft 50 are of equal diameter, so that rotating the shaft 50 advances both sides of the belt of carbon paper 40 at the same rate. The carbon paper 40 is advanced by rotating a manually actuated knob 57, which is shown in FIG. 5. Serrations 60 allow the knob 57 to be more easily turned. The knob 57 is integrally connected to a knob turning gear 58, which has teeth that mesh with teeth on a belt turning gear 59 on the shaft 50. When the knob 57 is rotated, the knob turning gear 58 is also turned, thereby effectuating the rotation of the belt turning gear 59 and the shaft 50. By turning the shaft 50, the rotation of the toothed rollers 44 and belt of carbon paper 40 is also effected.

Knob 57 is rotatably supported by the upper portion 24 of the housing 22. As shown in FIG. 5, the knob 57 extends part way through an aperture 62 in the upper portion 24 of the housing 22 so that the knob 57 can be manually rotated when the housing 22 is closed. The knob 57 can be rotated in either direction by a user in order to adjust the position of a segment 41 of the belt of carbon paper 40 and thereby select a color of choice for the copy of an image drawn on the transparent sheet 12.

The belt of carbon paper 40 is stretched taught and held in position by passive rollers 64 located at regular intervals along a shaft 66 on the interior of the belt of carbon paper 40 opposite and parallel to the shaft 50. The shaft 66 has axially outwardly-projecting projections 68, 69 at its opposite ends. These projections 68, 69 rest in notches 65*a*, 65*b* respectively so that the shaft 66 is freely rotatable. The shaft 66 is held in place on one end by a clip 70 which is secured to the lower portion 26 of the housing 22 and secures projection 68. On the other end of the shaft 66, projection 69 is secured in place by means of another clip (not shown).

As can be seen from FIG. 5, the carbon paper belt 40 can be readily moved, thereby changing the color of the copy produced by the apparatus 10, without having to lift open the transparent sheet 12 or the opaque sheet 30 and without disturbing the plain paper 67 underneath the belt of carbon paper 40. Rotating the knob 57 rotates the belt turning gear 59, causing the shaft 50 and toothed rollers 44 to advance the belt of carbon paper 40 in a desired direction. A different segment 41 of the belt of carbon paper 40 may thereby be positioned directly below the opaque sheet 30 without altering or erasing the image created on the transparent sheet 12. The plain paper 67 below the belt of carbon paper 40 also remains unmoved when the belt of carbon paper 40 is rotated.

FIG. 5 also illustrates the relative distances between the opaque sheet 30, the carbon paper 40 positioned below the opaque sheet 30, and the sheet of paper 67. These elements must be in close proximity, preferably within approximately one sixteenth of an inch of each other, in order to produce a copy on the sheet of paper 67 of the image 11 made on the transparent sheet 12. As best seen in FIG. 1*b*, pressure applied to the transparent sheet 12 by the tip 121 of the stylus 120 is transferred to the opaque sheet 30 and to the carbon paper 40. The carbon paper 40 is caused to deform sufficiently that the carbon paper 40 contacts the sheet of paper 67 at a point 68. At the point 68, a mark is produced on the sheet of paper 67 corresponding to the image formed on the transparent sheet 12 at the point 33.

When the stylus 120 is lifted from the transparent sheet 12, the transparent sheet 12 remains adhered to the plate 30, as described previously. The opaque sheet 30 does not adhere, at least to a significant extent, to the carbon paper 40. Likewise, the carbon paper 40 does not adhere, at least to as significant extent, to the sheet of paper 67. The carbon paper 40 can be moved so that a different segment 41 of the belt of carbon paper 40 is positioned over the sheet of paper 67. Because this segment 41 is capable of imparting a different color to the sheet of paper 67 when pressure is next applied to the transparent sheet 12, a different colored image may be produced on the sheet of paper 67.

Below the sheet of paper 67 is a means for supporting the sheet of paper 67. In a preferred embodiment this means also comprises a means for supporting multiple sheets of paper 67 selected from a plurality of sizes. In the preferred embodiment shown in FIGS. 5,7 and 9, the means for supporting multiple sheets of paper selected from a plurality of sizes is a selectively removable paper tray 80, shown best in FIG. 9, made from a suitably rigid material such as ABS plastic. The paper tray 80 is formed with a shallow, planar basin 81, and is thus able to support multiple sheets of plain paper 67. The tray 80 is also able to support paper of a plurality sizes by means of slidable cassette stops 82. As shown by the arrows in FIG. 7, the cassette stops 82 can be adjusted to fit paper of different widths and lengths. In a preferred embodiment, the cassette stops 82 are adjustable between $8\frac{1}{2}'' \times 11''$, the standard paper size in the U.S., and A4 size, the standard paper size in Europe.

When properly adjusted, the cassette stops 82 help to hold the plain paper 67 in place in the tray 80. This avoids the displacement of the plain paper 67 when the belt of carbon paper 40 is rotated and keeps the plain paper 67 positioned under the drawing surface of the transparent sheet 12. The cassette stops 82 also help to align the edges of the plain paper 67 with the edges of the frame 14 so that the long sides of the paper 67 are roughly parallel to the long sides of the frame 14 and so that the short sides of the paper 67 are roughly parallel to the short sides of the frame 14.

In order to determine whether plain paper 67 is loaded in the tray 80, a means for visually indicating the presence of a sheet of paper 67 on the tray 80 is provided. In a preferred embodiment of the present invention, this means includes a paper-out window 98 in the upper portion 24 of the housing 22, as shown in FIG. 1. If paper is loaded in the tray 80, a small area of that paper can be observed by a user of the apparatus 10 without opening the housing 22 by looking through the paper-out window 98. For example, if white paper is loaded in the tray 80 and the bottom of the tray 80 is colored blue, the presence of the color white in the paper-out window 98 informs the user that there is still paper 67 in the tray 80. If the user sees blue in the paper-out window 98, however, this indicates that there is no paper 67 loaded in the tray 80.

In a preferred embodiment of the present invention, the basin 81 of tray 80 is lined with dark-colored paper (not shown). If a display is then created on the transparent sheet 12 when there is no plain paper 67 in the tray 80, the carbon paper 40 will not mark the basin 81 of the tray 80 but rather the dark-colored paper, which may be replaced. Preferably, the dark colored paper may also contain instructions on how to use the apparatus 10 or other helpful information.

The tray 80 is itself supported and held in position by a tray support 90 and by the housing 22. As shown in FIG. 4, the tray support 90 includes guide tabs 92 along the long axis of the tray support '90 which limit the travel of the tray 80 along the short axis of the tray support 90. The movement of the tray 80 along the long axis of the tray support 90 is limited by a backstop 94 of the housing 22, as shown in FIG. 9.

Figure 9:
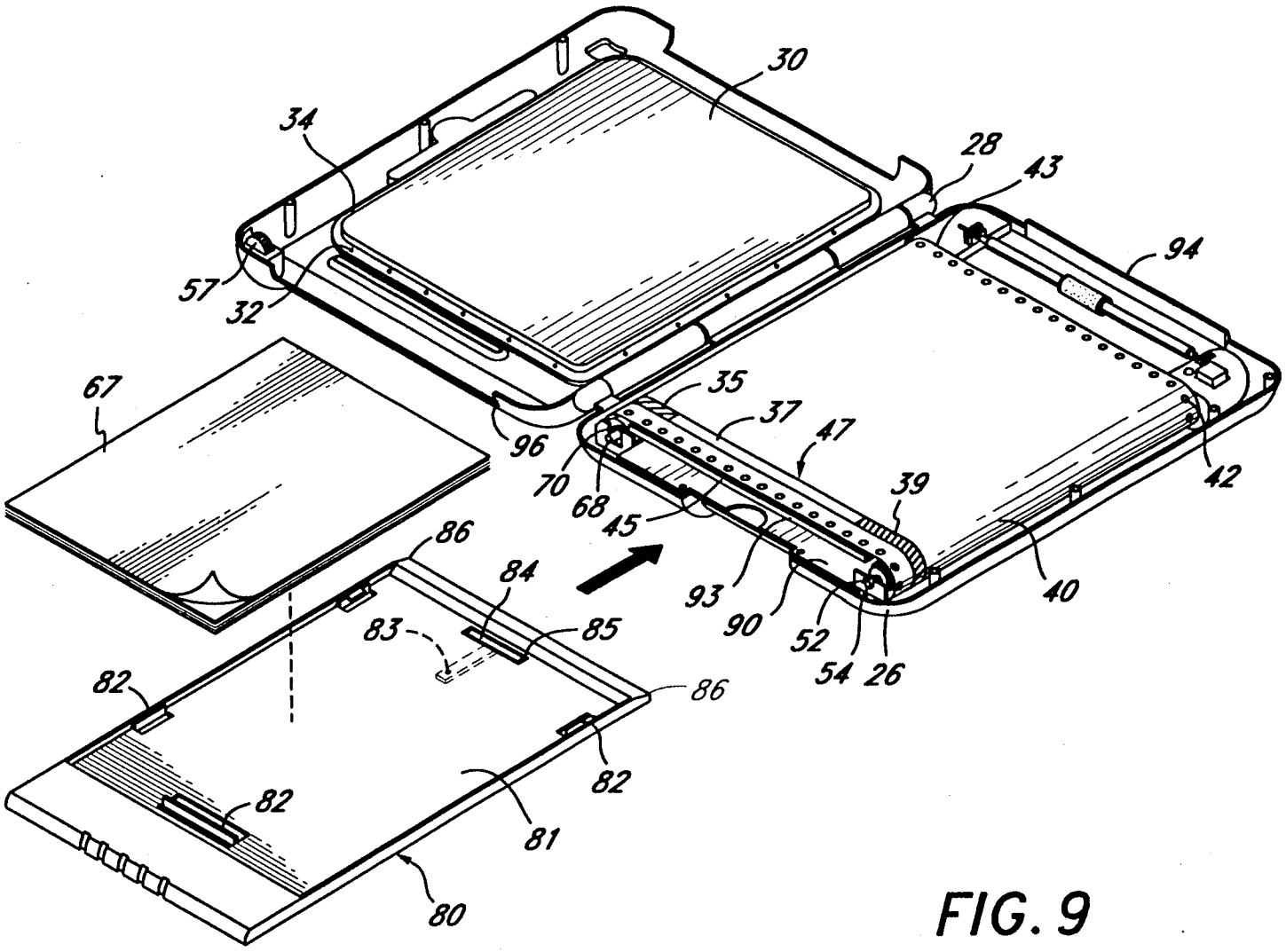
FIG. 9 is a partially exploded perspective view of the paper tray and housing of the apparatus, depicting the loading of paper in the tray and the insertion of the tray into the apparatus.

As shown in FIG. 9, the tray 80 is removed through an aperture 96 in the housing 22 opposite the backstop 94. The tray 80 is removed when it needs to be refilled with plain paper 67. When inserting the paper tray 80 into the apparatus through the aperture 96, the guide tabs 92 protect the belt of carbon paper 40 from being damaged by limiting the travel of the tray 80. Thus, the corners 86 of the tray 80 are prevented from being pushed into the belt of carbon paper 40 and tearing it. The guide tabs 92 also guide the tray 80 as it is inserted so that the tray 80 is aligned correctly beneath the carbon paper 40 and so that the means for ejecting the paper 67 from the apparatus 10 engages the paper 67 in the tray 80. A guide fender 93 also serves to keep the belt of carbon paper 40 from being damaged by the insertion of the paper tray 80 by holding up the lateral edge 45 of the belt of carbon paper 40 near the aperture 96 and, during insertion of the tray 80, guiding insertion of the tray 80 into the housing 22.

Figure 8:
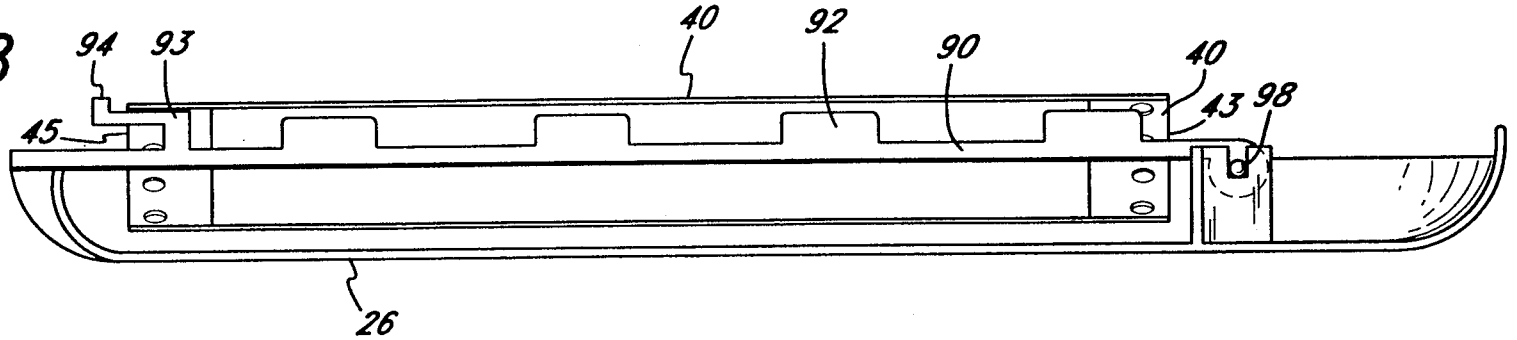
FIG. 8 is a schematic side view of the lower portion of the housing, the paper tray support, and the belt of carbon paper of the apparatus.
Figure 8A:
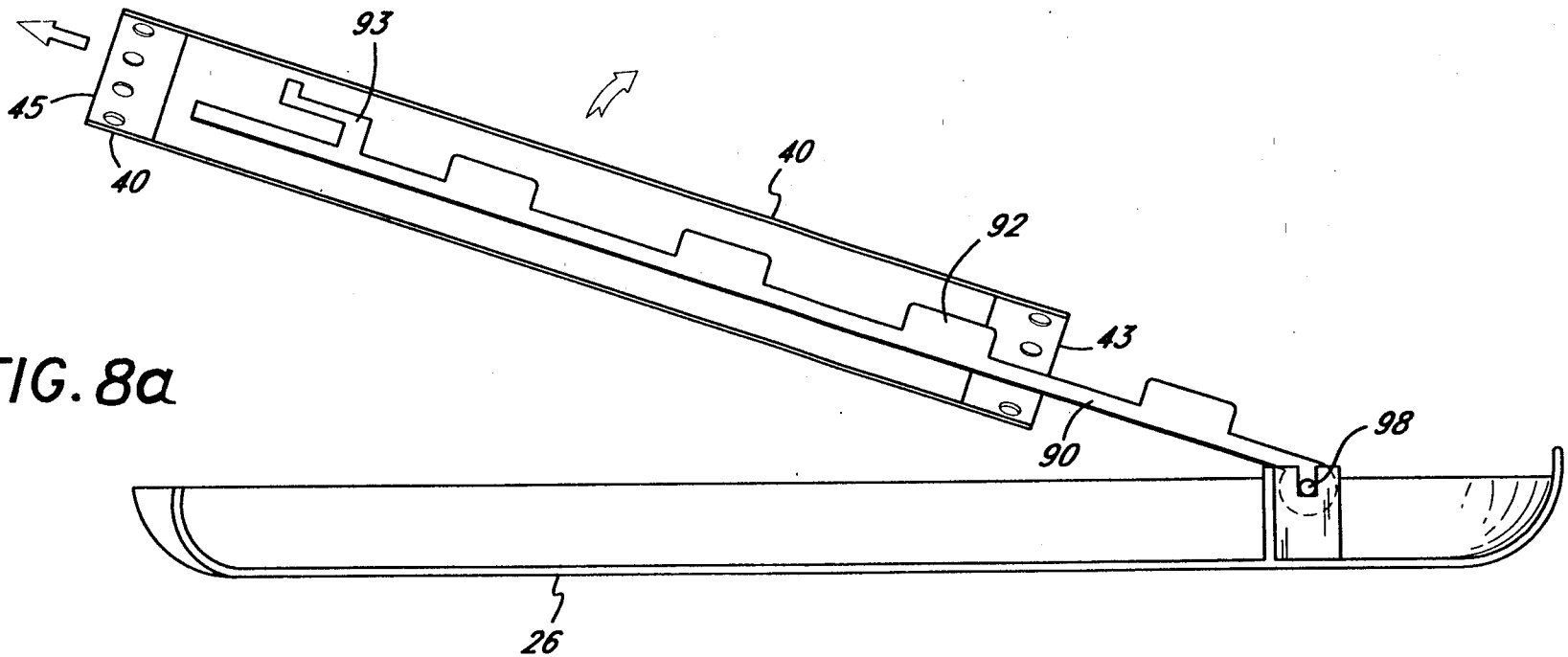
FIG. 8*a* is a schematic side view similar to that FIG. 8 in which the paper tray support is pivoted so that the belt of carbon paper can be removed.

As shown in FIGS. 8 and 8*a*, the tray support 90 is secured to the lower portion 26 of the housing 22 by hinges 98. The tray support 90 can be rotated about the hinges 98 in order to allow the belt of carbon paper 40 to be inserted or removed, as during manufacture or when replacing a spent or damaged belt of carbon paper 40. Before the tray support 90 in the assembled apparatus may be rotated, however, upper portion 24 of the housing 22 must be opened, as shown in FIG. 9. The shafts 50 and 66 must then be freed from the clips 52 and 70 and removed from the interior of the belt of carbon paper 40. After the shafts 50 and 66 have been removed from the housing 22, the tray support 90 and the belt of carbon paper 40 surrounding may be rotated into the position shown in FIG. 8*a*, preferably by 30° or more. The belt of carbon paper 40 may then be pulled outwardly along the long axis of the tray support 90 as indicated in FIG. 8*a*.

To place a new belt of carbon paper onto the tray support 90, either during manufacture or after a spent belt of carbon paper 40 has been removed, the tray support 90 is rotated upwardly, and the new belt of carbon paper 40 is slipped over it, past the lip 94 of the guide fender 93 so that the lateral edge 45 of the carbon paper 40 rests on the guide fender 93, as shown in FIG. 8. The tray support 90 and carbon paper 40 may then be rotated downwardly to the lower portion 26 of the housing 22, and the shafts 50 and 66 may then be inserted into the interior of the new belt of carbon paper on either side of the short axis of the tray support 90 so that the projections 53, 54 on the shaft 50 fit into the notches or slots 55*a* and 55*b* and the projections 68 and 69 on the shaft 66 fit into the notches 65*a* and 65*b*. The protruding pins 48 of the toothed rollers 44 on the shaft 50 may then be aligned with the perforations 42 on the belt of carbon paper 40. The projections 53 and 54 on the shaft 50 may then be clipped into place in order to secure the shaft 50 to the lower portion 26 of the housing 22. The projections 68 and 69 on the shaft 66 are also clipped into place in order to secure that shaft to the lower portion 26 of the housing 22.

In order to produce a copy of an image drawn on the transparent sheet 12 with the foregoing components, sufficient pressure must be exerted with the stylus 120 when producing a luminescent image on the transparent sheet 12 so that the pressure is transmitted through the transparent sheet 12 and the opaque sheet 30 to the belt of carbon paper 40, as previously described. The pressure of the stylus 120 transmitted to the belt of carbon paper 40 will mark the sheet of plain paper 67 supported below the belt of carbon paper 40 on the tray 80. Continuous pressure from the stylus 120 on the transparent sheet 12 as the stylus 120 is drawn across the transparent sheet 12 produces a luminescent image 11 on the transparent sheet 12 and a corresponding copy of that image 11 on the sheet of paper 67 due to the mark left on the paper 67 by the pressure of the stylus 120 transmitted to the carbon paper 40.

The color of the copy on the sheet of paper 67 will depend on the segment of the belt of carbon paper 40 positioned directly over the plain paper 67. If one segment is positioned over the plain paper 67 during the production of an image on the transparent sheet 12, an image of a single color will be produced on the plain paper. Multi-colored images, however, may also be produced. After pressure has been applied to a first portion of the transparent sheet 12, thereby creating a luminescent image on that first portion of the transparent sheet 12 and a corresponding copy of a first color on a sheet of plain paper 67 below a first segment 41 of the belt of carbon paper 40, the segment 41 of the belt of carbon paper 40 directly over the sheet of plain paper 67 is changed by actuating the knob 57. As this knob 57 is rotated, the belt of carbon paper 40 is selectively moved until the color strip 47 in the viewing window 49 indicates that a different segment 41 of carbon paper 40 is positioned directly over the sheet of paper 67 in the apparatus 10 so that copies of another desired color may be produced. To produce copies of a second desired color, pressure is applied over a second portion of the transparent sheet 12. This produces another luminescent image over this second portion of the transparent sheet 12 and a copy of a second color on the sheet of plain paper 67.

Standardized images of one or more colors can be produced with the aid of a planar stencil 124. In use, the stencil 124 is normally placed over the transparent sheet 12, as shown in FIG. 1*a*. An image may then be traced on the transparent sheet 12 by tracing the outlines of the stencil 124 with the stylus 120. A copy of this standardized image is reproduced on the plain paper 67 below the opaque sheet 30, and copies of a plurality of colors can be produced by the method discussed above. Alternatively, the stencil 124 may be placed between the transparent sheet 12 and the opaque sheet 30.

Figure 10:
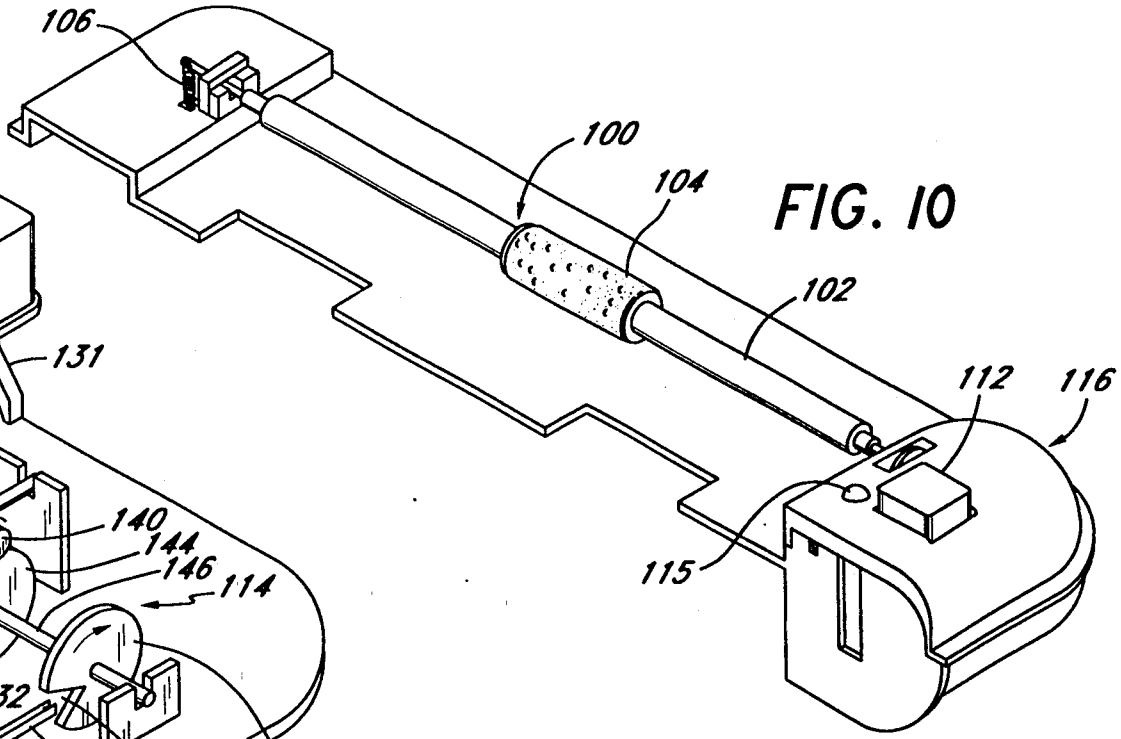
FIG. 10 is a perspective view of a section of the apparatus comprising the roller and an enclosed motor and timing device.

The apparatus of the present invention also includes means for selectively ejecting sheets of plain paper 67 from the housing 22 of the apparatus 10. Although the tray 80 can hold more than one sheet of paper at a time, the apparatus ejects only one sheet of plain paper 67 at a time even when multiple sheets are stored in the tray 80. In the preferred embodiment, the means for ejecting one sheet at a time is a powered, selectively rotatable roller 100 mounted in the housing 22. As best shown in FIG. 10, the roller 100 comprises a generally cylindrical axle 102 with a rubber friction roller 104 for frictionally gripping a sheet of paper 67. The axle 100 and friction roller 104 are urged downwardly toward the plain paper 67 on the tray 80 by springs 106.

As shown in FIG. 9, the tray 80 has provided thereon a pressure bar 84 which urges the multiple sheets of plain paper 67 in the tray 80 upwardly toward, and into engagement with, the friction roller 104. In the preferred embodiment the T-shaped pressure bar 84 is made from the same material as the tray 80 and is somewhat elastic. As shown in FIG. 9, the bar 84 is secured to the underside of the tray 80 by means of a screw 83 or other fastener, and a portion of the bar 84 extends through an aperture 85 in the paper tray 80 to a point slightly above the planar basin 81. The pressure bar 84 may be replaced with a conventional pinch roller or other alternative means of urging the paper 67 against the friction roller 104.

Figure 11:
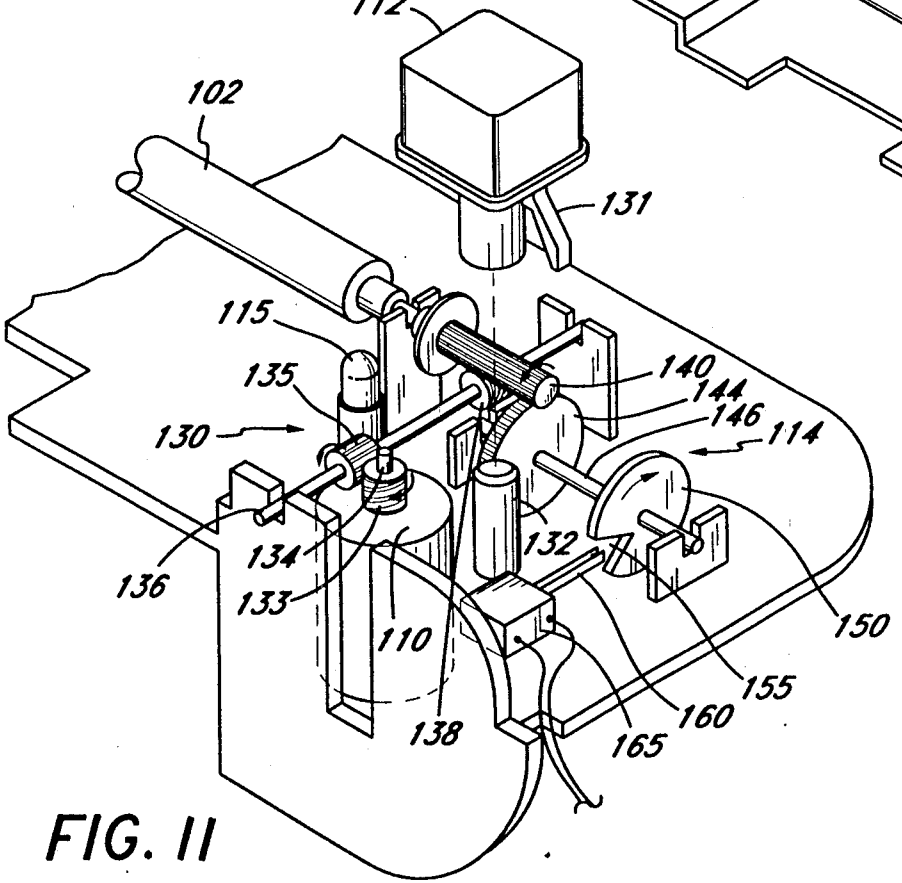
FIG. 11 is a perspective view showing the components of the motor and timing device.
Figure 12A:
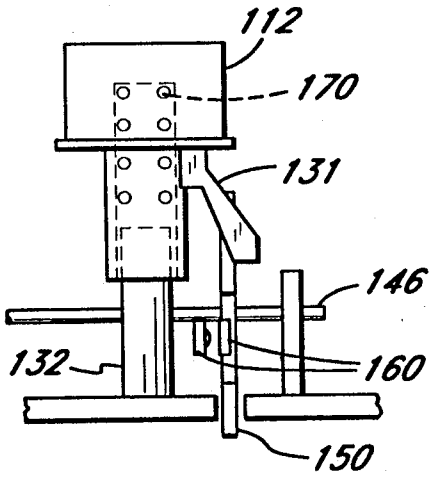
FIG. 12*a* is a partial side view of the elements of FIG. 12 along line 12*a*–12*a*.
Figure 12:
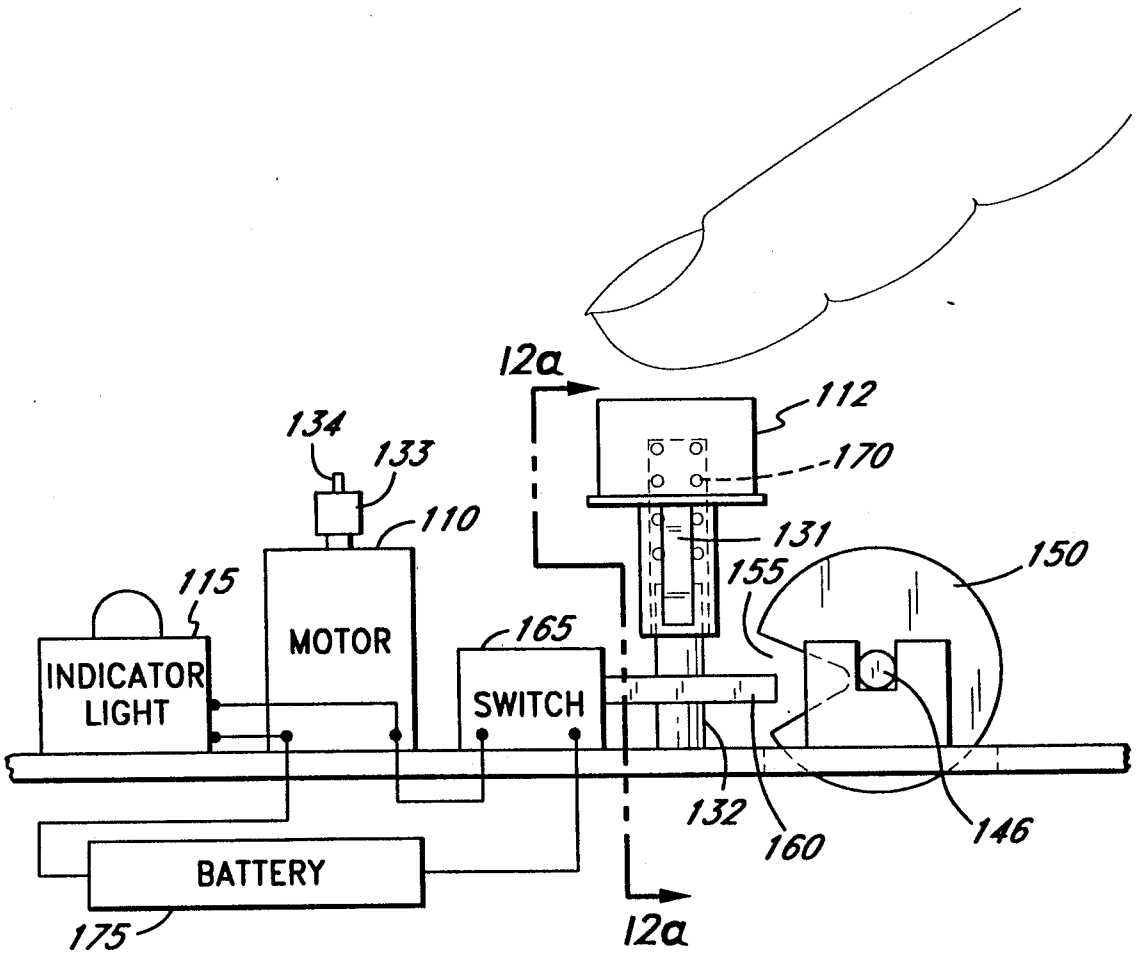
FIG. 12 is a semi-schematic front view showing the motor, selected elements of the timing device, and other associated components before the activation of the motor and timing device.
Figure 13A:
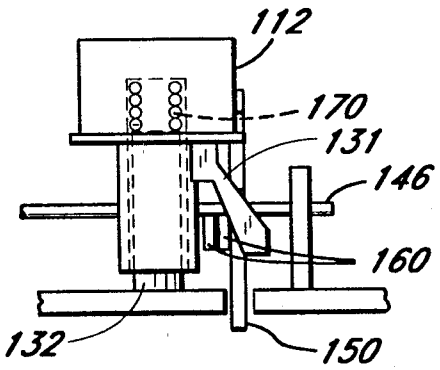
FIG. 13*a* is a partial side view of the elements of FIG. 13 along line 13*a*–13*a*.
Figure 13:
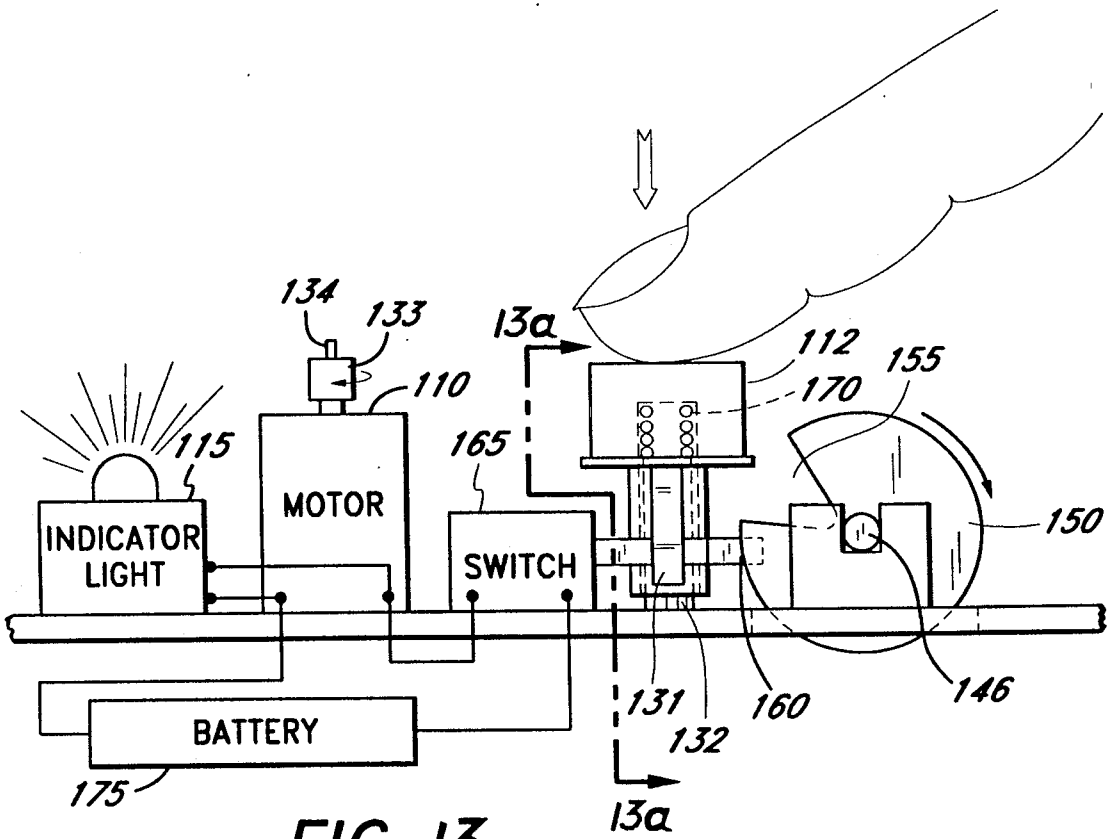
FIG. 13 is a semi-schematic front view similar to that of FIG. 12 showing the activation of the motor and timing device.
Figure 14A:
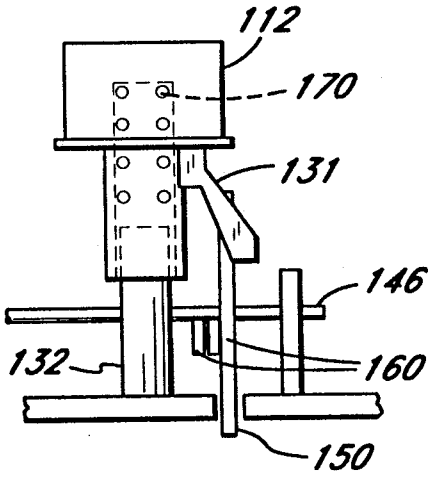
FIG. 14*a* is a partial side view of the elements of FIG. 14 along line 14*a*–14*a*.
Figure 14:
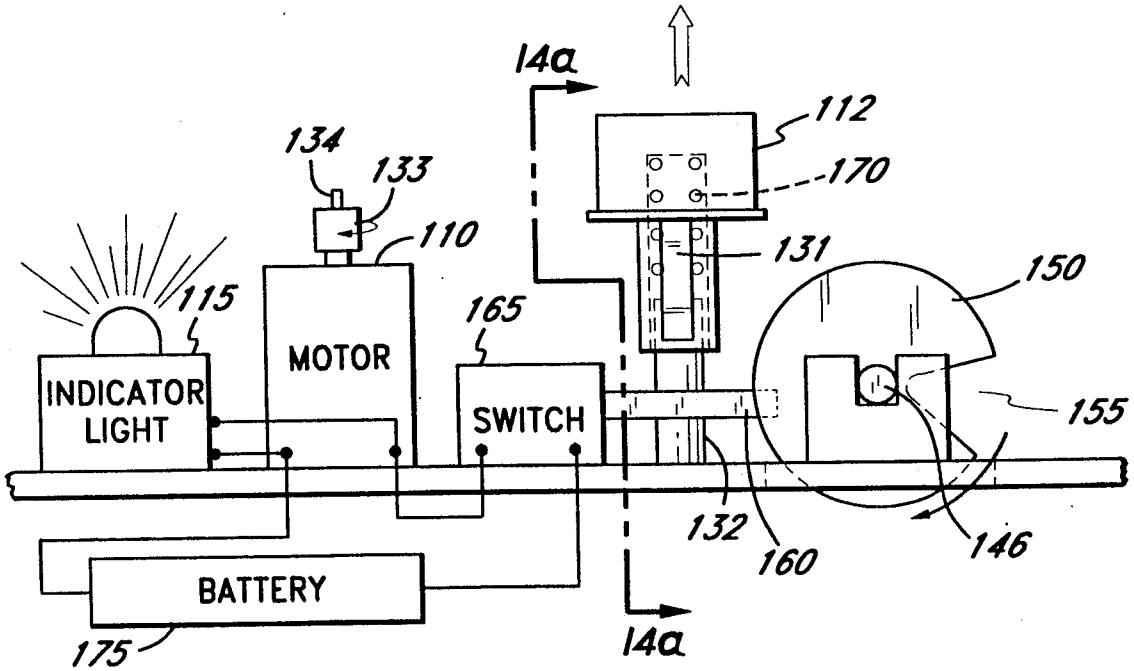
FIG. 14 is a semi-schematic front view similar to that of FIG. 12 showing the motor, selected elements of the timing device, and other associated components at a time after the motor and timing device have been activated and while the motor is running.

As shown in FIG. 11 and schematically in FIGS. 12–14, the axle 102 and friction roller 104 are rotated by means of an electric motor 110. The motor 110, powered by one or more batteries 175, is activated by the manual depression of a button 112. The batteries 175 may be conveniently housed in housing 111. As shown in FIG. 1, a preferred embodiment contemplates surrounding the button 112 with a raised ridge 113 which acts to minimize accidental activation of the motor 110 or damage to the button 112.

In a preferred embodiment, a light source 115 is activated while the motor 110 is activated to visually indicate operation of the motor 110 and consequent ejection of the paper 67. In a particularly preferred embodiment, the light source 115 takes the form of a light-emitting diode within a red housing. The light source 115 may either be replaced with or augmented with a buzzer (not shown). The buzzer would provide an audible indication of operation of the motor 110 and consequent ejection of the paper 67.

When the button 112 is depressed, a timing mechanism 114 is activated which runs the motor 110 for a predetermined period of time. The period of time must be long enough to at least partially eject the topmost sheet of paper on the tray 80, but not so long that the sheet of paper below it is also partially or fully ejected. The period of time should be selected to adequately eject a single sheet of paper of whatever sizes are contemplated to be used. For example, in a preferred embodiment, the time period is selected to allow ejection of a single A4 sheet, but not multiple sheets of 8½″×11″ paper.

The configuration and operation of the timing mechanism 114 as well as the configuration and operation of the components associated with the timing mechanism 114 are described in detail below with reference to FIGS. 10–14*a*. Referring now to FIG. 10, the motor 110 and the timing mechanism 114 are contained within an enclosure 116, from which the button 112 and the light 115 protrude. The motor 110 is in mechanical communication with the axle 102 so that the motor 110 drives rotation of the roller 100. The timing mechanism is in electrical communication with the light 115 and regulates the period of time that the diode 115 is illuminated, so that the light 115 is illuminated as long as the motor 110 is activated. The timing mechanism 114 is also in electrical communication with the motor 110 and regulates the number of rotations that the roller 100 undergoes each time the button 112 is depressed.

FIG. 11 shows the components inside the enclosure 116, which generally consists of two main mechanisms. The first mechanism is a power transmission system 130, which comprises the motor 110 together with a series of power transmission gears. The second main mechanism is a timing mechanism 114.

The power transmission system 130 includes a worm gear 133 affixed at the top of the motor 110 about a shaft 134. The worm gear 133 is mechanically coupled to a straight-toothed gear 135, which is fixed about a shaft 136. Also fixed about shaft 136 is a second worm gear 138, which is mechanically coupled to a second straight-toothed gear 140. The straight-toothed gear 140 is attached to the axle 102 to complete the power transmission system 130. It will be apparent that each worm gear causes a reduction in speed. This has been found to be quite advantageous in the present application, since the motor 110 generally causes the worm gear 133 to spin at a very high rotational velocity which exceeds the rotational velocity typically desired for turning the roller 100. Hence, the relatively fast rotation of the motor 110 is reduced to relatively slow rotation of the axle 102 and friction roller 104. It will also be apparent that other forms of gear trains may be substituted for that shown.

The timing mechanism 114 comprises a straight gear 144 which is mechanically coupled to the straight gear 140, and is fixed about a shaft 146. A circular plate or cam 150 is also fixed about the shaft 146. A portion of the cam 150 is removed so that a pie-shaped gap 155 is formed within the cam 150. A pair of conducting strips 160 are located proximate to the cam 150. The conducting strips 160 constitute the terminals of a switch 165, which is in electrical connection with the power source of the motor 110, completing the timing mechanism 114.

The operation of the timing mechanism 114 and the power transmission system 130 is best described with reference to FIGS. 11–14*a*. The button 112 is mounted on post 132 so that it can freely move up and down. A spring 170 (shown in phantom in FIG. 12 and 12*a*) within the button 112 and on the post 132 urges the button 112 upward. Extending downwardly at an angle from the button 112 is a prong 131, which points toward the terminal strips 160 extending from switch 165.

Before activation of the motor 110 the terminal strips 160 extend parallel from the switch 165 so that they do not contact each other, thereby forming an open circuit so that electricity is not conducted through the strips 160. The outer terminal strip 160 lies within the plane of the cam 150 and is positioned within the gap 155. Because the terminal strips 160 form an open circuit while spaced apart, the motor 110 remains inactive.

When the button 112 is depressed, as shown in FIGS. 13 and 13*a*, the spring 170 is compressed so that the prong 131 descends onto the terminal strips 160. The prong 131 is angled so that as it descends onto the strips 160, the edge of the prong 131 forces the strips 160 together until they touch, shown most clearly in FIG. 13*a*.

As shown in FIG. 11, the connection of the strips 160 causes electrical current to flow through the switch 165 so that the motor 110 and the light 115 both receive current from the battery 175, completing the circuit. Once the motor 110 receives current from the battery 175, the shaft 134 begins to rotate, and, along with it, worm gear 133.

The rotation of the worm gear 133 causes the straight-toothed gear 135 to rotate as well. The rotation of the straight-toothed gear 135 is transmitted to the worm gear 138 by means of the shaft 136. The rotation of the worm gear 138 causes the straight-toothed gear 140 to rotate, albeit at a rotational velocity less than that of the worm gear 138. The rotation of the straight-toothed gear 140 brings about two results. First, because the gear 140 is attached to the axle 102, the roller 100 is caused to rotate at the same rotational velocity as the gear 140. Thus, a sheet of paper in contact with the pad 104 will be dispensed from the copying apparatus at a rate determined by the rotational velocity of the gear 140. Second, because the straight-toothed gear 144 is coupled to the straight-toothed gear 140, the straight-toothed gear 144 will rotate at a velocity dependent upon the gear ratio between the gear 140 and the gear 144. The rotation of the gear 144 will be transmitted to the cam 150 via the shaft 146, so that the position of the pie-shaped gap 155 is changed, as shown in FIG. 13.

When the button 112 is released, as shown in FIGS. 14 and 14*a*, the spring 170 urges the button 112 and its prong 131 to release the terminal strips 160. However, contact is maintained between the terminal strips 160 because the cam 150 now urges the terminal strips 160 together. That is, the edge of the cam 150 is pressed against the strips 160, causing them to maintain contact. This is shown most clearly in FIG. 14*a*. Therefore, current continues to flow so that the roller 100 keeps rotating as described above.

When the cam 150 has made a complete rotation, however, the gap 155 returns to its original position adjacent to the terminal strips 160. Thus, when the edge of the cam 150 is no longer pressed against the terminal strips 160, the strips 160 return to their original spaced parallel position and contact is broken between the terminal strips 160. This causes the flow of current to cease, so that the light 115 and the motor 110 become inactive. The motion of the roller 100 also halts so that paper is no longer ejected from the apparatus.

From the foregoing description it can be seen that the timing mechanism 114 permits the roller 100 to rotate during the time that it takes the cam 150 to complete one rotation. Furthermore, because a constant gear ratio is maintained between the gear 140 and the gear 144, the number of complete rotations of the roller 100 is always constant for each rotation of the cam 150. In fact, the ratio between the number of rotations of the roller 100 and the number of rotations of the cam 150 is equal to the gear ratio between the gear 140 and the gear 144.

While particular embodiments of the invention have been described in detail for ease of understanding, it will be apparent to those of ordinary skill in the art that the disclosed embodiments may be modified within the scope of the invention. Therefore, the foregoing description is to be considered exemplary rather than limiting. The true scope of the invention is that defined by the following claims.

What is claimed is:

1. An apparatus for providing a luminescent display and producing a multi-colored paper copy of said display, comprising:

a transparent sheet of pliable plastic having dispersed therein a luminescent pigment or dye, said sheet having outer edges, an upper surface and a smooth lower surface;

a frame which is coextensive with the outer edges of said transparent sheet, said frame being secured to the outer edges of said transparent sheet;

a housing, wherein said frame is hingedly connected to said housing;

a pliable, planar opaque sheet having a smooth upper surface and a lower surface, said opaque sheet being secured to said housing, wherein when said transparent sheet and frame are overlaid on top of said opaque sheet said lower surface of said transparent sheet and said upper surface of said opaque sheet are in close proximity, a portion of said lower surface of said transparent sheet selectively adheres to said upper surface of said opaque sheet when sufficient pressure is applied to said portion of said transparent sheet so that said portion of said lower surface of said transparent sheet contacts said upper surface of said opaque sheet, said portion providing a luminescent display;

carbon paper situated in said housing underneath said opaque sheet, said carbon paper having a plurality of segments, each of which is capable of producing images of a different color on a sheet of plain paper, said carbon paper forming a belt that is selectively rotatable within said housing;

means for selectively moving said carbon paper without displacing said transparent or opaque sheets to change the segment of said carbon paper position directly beneath said lower surface of said opaque sheet;

means for visually indicating the color of said carbon paper segment directly beneath said lower surface of said opaque sheet;

a selectively removable tray in said housing beneath the segment of said carbon paper positioned directly beneath said lower surface of said opaque sheet, said tray having a planar surface for supporting a plurality of sheets of paper and means for selectively accommodating paper of a plurality of sizes;

means for visually indicating the presence of paper within said tray;

a sheet of paper selected from a plurality of sizes supported by said tray and situated between said tray and said segment of carbon paper positioned directly beneath said lower surface of said opaque sheet, whereby the selective application of pressure to areas of said transparent sheet is communicated through said opaque sheet to said carbon paper so that an image is created on said sheet of paper corresponding to said areas of said transparent sheet over which pressure is applied; and a powered, selectively rotatable roller rotatably mounted in said housing for selectively ejecting from said housing said sheet of paper bearing said image.

2. The apparatus of claim 1, further comprising means for removably securing said transparent sheet to said frame.

3. The apparatus of claim 2, wherein said means includes a rigid, rectangular, planar frame.

4. The apparatus of claim 1, further comprising means for removably securing said opaque sheet to said housing.

5. The apparatus of claim 4, wherein said means includes a rigid, rectangular, planar frame.

6. The apparatus of claim 1, further comprising a light source selectively operable along with said roller for providing a visual indication of the operation of said roller.

7. The apparatus of claim 1, further comprising a planar stencil for applying to said transparent sheet and assisting in creating said luminescent display.

8. The apparatus of claim 1, further comprising a stylus having a rounded point for applying pressure to said transparent sheet so as to create said luminescent display without damaging said transparent sheet.

9. The apparatus of claim 8, wherein said stylus is attached to said housing by a tether.

10. The apparatus of claim 8, wherein said housing has formed therein a retaining well for storing said stylus.

11. The apparatus of claim 1, wherein said plurality of segments include segments colored red, blue and black.

12. An apparatus for providing a luminescent display and producing a multi-colored paper copy of said display, comprising:

a pliable, planar transparent sheet having dispersed therein a luminescent pigment or dye and having a smooth lower surface;

a pliable, planar opaque sheet having a smooth upper surface and a lower surface, said opaque sheet positioned below said transparent sheet so that said lower surface of said transparent sheet and said upper surface of said opaque sheet are facing each other and in close proximity;

carbon paper having a plurality of colored segments, a first segment being positioned directly beneath and in close proximity to said lower surface of said opaque sheet;

means for selectively moving said carbon paper without displacing said transparent or opaque sheets to change the color of said first segment of said carbon paper and allow the creation of multi-colored copies;

a sheet of paper underneath and in close proximity to said first segment of said carbon paper; and a stylus having a rounded point at one end thereof for applying pressure to a discrete portion of said transparent sheet sufficient to cause said lower surface of said transparent sheet to selectively adhere to said upper surface of said opaque sheet, thereby creating a luminescent display at said portion of said transparent sheet, and to transmit said pressure through said opaque sheet and to said carbon paper so as to create an image on said paper underneath said portion of said transparent sheet, thereby producing a copy of said display on said paper.

13. The apparatus of claim 12, wherein said means for selectively moving said carbon paper is manually actuated.

14. The apparatus of claim 13 wherein said means for selectively moving said carbon paper includes a shaft having a plurality of rollers.

15. The apparatus of claim 14, wherein said carbon paper forms a roll having regularly-spaced perforations along a lateral edge thereof and wherein one of said rollers has protruding pins that engage said perforations.

16. The apparatus of claim 12, further comprising a housing and means for removably securing said opaque sheet to said housing.

17. The apparatus of claim 16, wherein said means for removably securing includes a rigid, rectangular, planar frame.

18. The apparatus of claim 16, further comprising a means for visually indicating the color of said first segment of said carbon paper.

19. The apparatus of claim 18, wherein said means for indicating includes an aperture in said housing.

20. The apparatus of claim 18, wherein said means for removably securing includes a rigid, rectangular, planar frame.

21. The apparatus of claim 16, further comprising a frame hingedly secured to said housing and means for removably securing said transparent sheet to said frame.

22. An apparatus for providing a luminescent display and producing a multi-colored paper copy of said display, comprising:

a pliable planar transparent sheet having dispersed therein a luminescent pigment or dye and having a smooth lower surface;

a pliable planar opaque sheet having a smooth upper surface and a lower surface, said opaque sheet positioned below said transparent sheet so that said lower surface of said transparent sheet and said upper surface of said opaque sheet are facing each other and in close proximity;

carbon paper having a plurality of colored segments, a first segment being positioned directly beneath and in close proximity to said lower surface of said opaque sheet;

means for selectively moving said carbon paper; and means for supporting paper underneath and in close proximity to said first segment of said carbon paper.

23. The apparatus of claim 22, further comprising means for indicating the color of said first segment of said carbon paper.

24. An apparatus for providing a luminescent display and producing a paper copy of said display, comprising:

a pliable, planar transparent sheet having dispersed therein a luminescent pigment or dye and having a smooth lower surface;

a pliable, planar opaque sheet having a smooth upper surface and a lower surface, said opaque sheet positioned below said transparent sheet so that said lower surface of said transparent sheet and said upper surface of said opaque sheet are facing each other and in close proximity;

carbon paper positioned directly beneath and in close proximity to said lower surface of said opaque sheet; and means for supporting adjustably, aligning and positively locating a sheet of paper selected from a plurality of sizes underneath and in close proximity to said carbon paper.

25. The apparatus of claim 24, wherein said plurality of sizes include 8½" by 11" and A4.

26. The apparatus of claim 24, further comprising means for determining the presence of a sheet of paper in said means for supporting.

27. The apparatus of claim 24, wherein said means for supporting a sheet of paper comprises a selectively removable tray having a planar surface below and in close proximity to said first segment of said carbon paper.

28. The apparatus of claim 27, wherein said planar surface is lined with paper adhered to said planar surface.

29. An apparatus for providing a luminescent display and producing a paper copy of said display, comprising:

a pliable, planar transparent sheet having dispersed therein a luminescent pigment or dye and having a smooth lower surface;

a pliable, planar opaque sheet having a smooth upper surface and a lower surface, said opaque sheet positioned below said transparent sheet and said upper surface of said opaque sheet are facing each other and in close proximity;

carbon paper positioned directly beneath and in close proximity to said lower surface of said opaque sheet;

means for supporting a plurality of sheets of paper underneath and in close proximity to said carbon paper; and means for selectively ejecting said plurality of sheets of paper, one at a time, from said apparatus.

30. The apparatus of claim 29, wherein said means for supporting includes a tray having a planar surface underneath and in close proximity to said carbon paper.

31. The apparatus of claim 30, wherein said means for ejecting includes a selectively rotatable, powered roller above said tray, said roller being urged downwardly toward said tray into contact with any paper within said tray.

32. The apparatus of claim 31, wherein said means for ejecting further includes an electric motor and a gear train operatively connecting said electric motor and said roller.

33. The apparatus of claim 32, wherein said means for ejecting further includes a battery electrically connected to said electric motor for powering said electric motor.

34. The apparatus of claim 32, wherein said means for ejecting further includes a switch for selectively operating said motor.

35. The apparatus of claim 34, wherein said switch includes a cam for causing activation of said switch to operate said motor for a predetermined period of time sufficient to eject a sheet of paper from said apparatus.

36. The apparatus of claim 34, comprising a light electrically connected to said motor and said switch, said light being illuminated while said motor is operated.

37. The apparatus of claim 29, further comprising means for visually indicating the presence of paper on said means for supporting.

38. The apparatus of claim 29, further comprising means for visually indicating the color of said carbon paper.

39. An apparatus, comprising:

a transparent sheet having dispersed therein a luminescent pigment or dye;

an opaque sheet positioned directly beneath and in close proximity to said transparent sheet;

carbon paper positioned directly beneath and in close proximity to said opaque sheet;

means for supporting a plurality of sheets of paper directly underneath and in close proximity to said carbon paper; and means for selectively ejecting said plurality of sheets of paper, one at a time, from said apparatus,

40. The apparatus of claim 39, further comprising means for selectively ejecting sheets of paper from said apparatus.

41. An apparatus, comprising:

a transparent sheet having dispersed therein a luminescent pigment or dye;

an opaque sheet positioned directly beneath and in close proximity to said transparent sheet;

multi-colored, moveable carbon paper, a portion of said carbon paper being positioned directly beneath and in close proximity to said opaque sheet; and means for supporting a sheet of paper directly underneath and in close proximity to said carbon paper, whereby the multi-colored carbon paper in movable relative to said sheet of paper such that a multi-colored paper copy of a luminescent display produced using said apparatus may be made.

42. An apparatus, comprising:

a transparent sheet having dispersed therein a luminescent pigment or dye;

an opaque sheet positioned directly beneath and in close proximity to said transparent sheet;

carbon paper positioned directly beneath and in close proximity to said opaque sheet; and means for supporting adjustably aligning and positively locating a sheet of paper chosen from a plurality of sizes directly underneath and in close proximity to said carbon paper.

43. An apparatus for providing a luminescent display and allowing ready replacement of components, comprising:

a housing having a generally planar surface having an aperture therethrough, said housing and aperture surrounded by a first lip extending from said housing perpendicular to said planar surface of said housing aperture;

a pliable opaque sheet having edges forming a periphery, said sheet being stretched across said housing aperture, over said first lip and against said housing, said edges of said opaque sheet extending outside said first lip;

a first generally planar, rectangular retaining frame having a central aperture therethrough large enough to fit over said first lip;

a plurality of fasteners fastening said retaining frame to said housing, thereby urging said opaque sheet about said periphery thereof firmly against said housing and stretching said opaque sheet over said first lip so that said opaque sheet is stretched taut across said housing aperture;

a frame rotatably attached to said housing having an aperture therethrough, said frame aperture is surrounded by a second lip extending from said frame perpendicular to said planar surface of said frame aperture;

a pliable transparent sheet having fluorescent pigment dispersed therethrough stretched across said frame aperture over said second lip and against said frame, said edges of said transparent sheet extending outside said second lip;

a second generally planar, rectangular retaining frame having a central aperture large enough to fit over said second lip; and a plurality of fasteners fastening said second retaining frame to said frame, thereby urging said transparent sheet about said periphery thereof firmly against said frame and stretching said transparent sheet over said second lip, whereby the portion of said transparent sheet within said frame aperture may be overlaid on the portion of said opaque sheet within said housing aperture in a close parallel relationship.

44. The apparatus of claim 43, wherein said first retaining frame includes four straight segments.

45. The apparatus of claim 43, wherein said second retaining frame includes four straight segments.

46. A method of creating a luminescent display and a multi-colored paper copy of said display, comprising the steps of:

providing a pliable, planar transparent sheet having dispersed therein a luminescent pigment or dye and having a smooth lower surface;

providing a pliable, planar opaque sheet having a smooth upper surface and a lower surface, said opaque sheet positioned below said transparent sheet so that said lower surface of said transparent sheet and said upper surface of said opaque sheet are facing each other and in close proximity;

providing carbon paper having a plurality of colored segments, a first segment being positioned directly beneath and in close proximity to said lower surface of said opaque sheet;

providing means for selectively moving said carbon paper without displacing said transparent or opaque sheets to change the color of said first segment of said carbon paper and allow the creation of multi-colored copies;

providing a sheet of paper underneath and in close proximity to said first segment of said carbon paper;

providing a stylus having a rounded point at one end thereof;

using said means for selectively moving to select a first color of said first segment of said carbon paper;

applying pressure with said stylus to a first portion of said transparent sheet sufficient to cause said lower surface of said transparent sheet to selectively adhere to said upper surface of said opaque sheet, thereby creating a luminescent display at said first portion of said transparent sheet, and to transmit said pressure through said opaque sheet and to said carbon paper so as to create an image of said first color on said paper underneath said first portion of said transparent sheet;

using said means for selectively moving to move said carbon paper and select a second color of said first segment of said carbon paper; and applying pressure with said stylus to a second portion of said transparent sheet sufficient to cause said lower surface of said transparent sheet to selectively adhere to said upper surface of said opaque sheet, thereby creating a luminescent display at said second portion of said transparent sheet, and to transmit said pressure through said opaque sheet and to said carbon paper so as to create an image of said second color on said paper underneath said second portion of said transparent sheet, whereby a multi-colored copy of said luminescent display is created on said paper.

47. A method of creating a luminescent display and a paper copy of said display, comprising the steps of:

providing a transparent sheet having dispersed therein a luminescent pigment or dye;

providing an opaque sheet positioned directly beneath and in close proximity to said transparent sheet;

providing means for supporting a plurality of sheets of paper directly underneath and in close proximity to said carbon paper;

providing a plurality of sheets of paper in said means for supporting, the top sheet of said plurality of sheets being directly underneath said carbon paper;

applying pressure to a selected portion of said transparent sheet, through said opaque sheet and to said carbon paper, thereby creating a luminescent image on said portion of said transparent sheet and an image directly underneath said portion on said top sheet.

48. The method of claim 47, further comprising the step of ejecting said top sheet from said means for supporting.

49. A method of creating a luminescent display and a multi-colored paper copy of said display, comprising the steps of:

providing a transparent sheet having dispersed therein a luminescent pigment or dye;

providing an opaque sheet positioned directly beneath and in close proximity to said transparent sheet;

providing multi-colored, moveable carbon paper, a first portion of said carbon paper being positioned directly beneath and in close proximity to said opaque sheet;

providing means for supporting a sheet of paper directly underneath and in close proximity to said carbon paper; and selecting a first color of said first portion of said carbon paper;

applying pressure to a first selected portion of said transparent sheet, through said opaque sheet and to said carbon paper, thereby creating a luminescent image on said first selected portion of said transparent sheet and an image of said first color directly underneath said first selected portion of said sheet of paper;

selecting a second color of said first portion of said carbon paper; and applying pressure to a second selected portion of said transparent sheet, through said opaque sheet and to said carbon paper, thereby creating a luminescent image on said second selected portion of said transparent sheet and an image of said second color directly underneath said second selected portion on said sheet of paper.

50. A method of creating a luminescent display and a multi-colored paper copy of said display, comprising the steps of:

providing a transparent sheet having dispersed therein a luminescent pigment or dye;

providing an opaque sheet positioned directly beneath and in close proximity to said transparent sheet;

providing carbon paper positioned directly beneath and in close proximity to said opaque sheet; and providing means for supporting a sheet of paper chosen from a plurality of sizes directly underneath and in close proximity to said carbon paper;

selecting a sheet of paper from said plurality of sizes;

adjusting said means for supporting to align and positively locate said sheet of paper;

placing said sheet of paper onto said means for supporting;

applying pressure to a selected portion of said transparent sheet, through said opaque sheet and to said carbon paper, thereby creating a luminescent image on said portion of said transparent sheet and an image directly underneath said portion on said sheet of paper.

51. A method for producing a belt of carbon paper, comprising:

providing a generally rectangular planar carrier sheet having first and second opposing sides, two parallel edges and two ends;

providing a planar sheet of carbon paper;

adhering said sheet of carbon paper to said first side of said carrier sheet; and fastening said ends of said carrier sheet together to form a continuous belt having parallel edges, said carbon paper facing the interior of said belt.

52. A method for producing a belt of carbon paper, comprising:

providing a generally rectangular planar carrier sheet having first and second opposing sides, two parallel edges and two ends;

applying ink to said first side of said carrier sheet; and fastening said ends of said carrier sheet together to form a continuous belt having parallel edges, said first side facing the interior of said belt.

53. A method of replacing an opaque sheet on a luminescent display and copying apparatus, comprising the steps of:

providing a luminescent display and copying apparatus, including:

a housing having a generally planar surface having an aperture therethrough, said aperture surrounded by a lip extending from said housing perpendicular to said planar surface of said aperture;

a pliable opaque sheet having edges forming a periphery, said sheet being stretched across said aperture, over said lip and against said housing, said edges of said opaque sheet extending outside said lip;

a generally planar, rectangular retaining frame having a central aperture large enough to fit over said lip; and a plurality of fasteners fastening said retaining frame to said housing, thereby urging said opaque sheet about said periphery thereof firmly against said housing and stretching said opaque sheet over said lip; and removing said fasteners;

removing said retaining frame;

removing said opaque sheet from said housing;

placing a replacement opaque sheet against said housing, across said aperture and over said lip;

replacing said retaining frame against said replacement sheet; and securing said retaining frame to said housing with said fasteners, thereby urging said replacement sheet about said periphery thereof firmly against said housing and stretching said replacement sheet over said lip.

54. A method of replacing a transparent sheet on a luminescent display and copying apparatus, comprising the steps of:

providing a luminescent display and copying apparatus, including:

a housing;

a frame rotatably attached to said housing having a generally planar surface having an aperture therethrough, said aperture surrounded by a lip extending from said frame perpendicular to said planar surface of said aperture;

a pliable transparent sheet having edges forming a periphery, said sheet being stretched across said aperture, over said lip and against said frame, said edges of said transparent sheet extending outside said lip;

a generally planar, rectangular retaining frame having a central aperture large enough to fit over said lip; and a plurality of fasteners fastening said retaining frame to said frame, thereby urging said transparent sheet about said periphery thereof firmly against said frame and stretching said transparent sheet over said lip; and removing said fasteners;

removing said retaining frame;

removing said transparent sheet from said frame;

placing a replacement transparent sheet against said frame, across said aperture and over said lip;

replacing said retaining frame against said replacement sheet; and securing said retaining frame to said frame with said fasteners, thereby urging said replacement sheet about said periphery thereof firmly against said frame and stretching said replacement sheet over said lip.

* * * * *